US008678368B2

(12) United States Patent
Yoshida

(10) Patent No.: US 8,678,368 B2
(45) Date of Patent: Mar. 25, 2014

(54) IMAGE FORMING APPARATUS

(75) Inventor: Hiroki Yoshida, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/486,190

(22) Filed: Jun. 1, 2012

(65) Prior Publication Data

US 2012/0313309 A1 Dec. 13, 2012

(30) Foreign Application Priority Data

Jun. 8, 2011 (JP) ..... 2011-128529

(51) Int. Cl.
*B65H 31/04* (2006.01)
*B65H 37/04* (2006.01)

(52) U.S. Cl.
USPC ..... 270/58.13; 270/58.07; 270/58.08; 270/58.11; 270/58.28

(58) Field of Classification Search
USPC ..... 270/58.07, 58.08, 58.11, 58.13, 58.28
See application file for complete search history.

(56) References Cited

U.S. PATENT DOCUMENTS

| | | | | |
|---|---|---|---|---|
| 5,497,984 | A | 3/1996 | Murakami et al. | |
| 7,519,321 | B2 * | 4/2009 | Matsutomo | 399/410 |
| 7,549,621 | B2 * | 6/2009 | Kotani | 270/58.13 |
| 7,798,481 | B2 * | 9/2010 | Terao et al. | 270/58.13 |
| 7,918,450 | B2 | 4/2011 | Yoshida | |
| 8,100,391 | B2 * | 1/2012 | Terao et al. | 270/58.13 |
| 2007/0085257 | A1 * | 4/2007 | Kang | 270/58.07 |
| 2010/0019442 | A1 | 1/2010 | Yoshida | |
| 2010/0025910 | A1 | 2/2010 | Nakayama | |
| 2010/0237556 | A1 | 9/2010 | Azuma et al. | |
| 2010/0320681 | A1 * | 12/2010 | Terao et al. | 271/314 |
| 2011/0064427 | A1 | 3/2011 | Yoshida | |
| 2011/0074081 | A1 | 3/2011 | Hirabayashi et al. | |
| 2011/0091260 | A1 | 4/2011 | Azuma et al. | |

FOREIGN PATENT DOCUMENTS

| | | | |
|---|---|---|---|
| JP | 09278258 | A | 10/1997 |
| JP | 3658509 | B2 | 3/2005 |
| JP | 2008044692 | A | 2/2008 |

OTHER PUBLICATIONS

English abstract for JP 11-310362 corresponds to JP 3658509, Nov. 9, 1999.

Extended European Search Report for corresponding European patent application No. 12171183.2 dated Dec. 11, 2013.

* cited by examiner

*Primary Examiner* — Leslie A Nicholson, III

(74) *Attorney, Agent, or Firm* — Harness, Dickey & Pierce, P.L.C.

(57) ABSTRACT

In an embodiment, a post-processing apparatus includes: a stacking tray; an upward and downward driving unit; a binding unit; and an upward and downward driving control unit. The upward and downward driving unit drives the stacking tray in vertical direction. The binding unit performs binding on recording media on the stacking tray. The upward and downward driving control unit controls such that: descent of the stacking tray is performed before a leading edge of a first sheet among the recording media on which the binding is to be performed reaches a position on the stacking tray; and after the leading edge of the first sheet is positioned on the stacking tray, ascent of the stacking tray is performed before a leading edge of a second sheet among the recording media reaches a position on the stacking tray.

8 Claims, 12 Drawing Sheets

FIG.13A

| BINDING POSITION | TRAY DESCENT TIME [msec] |
|---|---|
| FRONT BINDING | 200 |
| REAR BINDING | 200 |
| TWO-POINT BINDING | 150 |

FIG.13B

| SHEET TYPE | TRAY DESCENT TIME [msec] |
|---|---|
| THIN PAPER | 200 |
| PLAIN PAPER | 180 |
| THICK PAPER | 150 |

FIG.13C

| NUMBER OF SHEETS TO BE BOUND | TRAY DESCENT TIME [msec] |
|---|---|
| 20 OR LESS | 200 |
| EQUAL TO OR MORE THAN 21 AND EQUAL TO OR LESS THAN 40 | 180 |
| 41 OR MORE | 150 |

IMAGE FORMING APPARATUS

CROSS-REFERENCE TO RELATED APPLICATIONS

The present application claims priority to and incorporates by reference the entire contents of Japanese Patent Application No. 2011-128529 filed in Japan on Jun. 8, 2011.

BACKGROUND OF THE INVENTION

1. Field of the Invention

The embodiment relates to a post-processing apparatus capable of performing binding as post-processing on recording media such as sheets on which an image is formed by an image forming apparatus, such as a copying machine, a facsimile, and a printer, and to an image forming apparatus including the post-processing apparatus.

2. Description of the Related Art

Widely known are post-processing apparatuses capable of performing binding as post-processing on recording media such as sheets on which an image is formed by an image forming apparatus, such as a copying machine, a facsimile, and a printer (refer to Japanese Patent No. 3658509 and Japanese Patent Application Laid-open No. H9-278258, for example). Such a post-processing apparatus may be independent of an image forming apparatus (refer to Japanese Patent No. 3658509 and Japanese Patent Application Laid-open No. H9-278258, for example), or may be included in an image forming apparatus as a part of the configuration thereof.

Post-processing apparatuses typically include a tray on which recording media passing through a section for performing post-processing are stacked.

The recording media are required to be discharged and stacked on the tray from the main body of the apparatus properly. However, if the stacking height of the recording media on the tray increases, the recording media on the tray may prevent discharge of a recording medium from the main body.

To address this, conventionally, a technology for causing the tray to descend depending on the stacking height has been developed (refer to Japanese Patent No. 3658509 and Japanese Patent Application Laid-open No. H9-278258, for example).

The stacking height will now be explained in greater detail. A recording medium may curl because of heat and pressure applied thereto while an image is being formed. In particular, if so-called side curl occurs in which both side edges of the recording medium curl upward, the stacking height increases compared with the case where the recording medium is in a planer shape. Furthermore, if the post-processing apparatus has a function to perform binding, and a bundle of recording media on which the binding is performed is stacked on the tray, a part thus bound is made bulky in the recording media. As a result, the stacking height increases compared with the case where the recording media is in a planer shape.

To discharge a recording medium from the main body properly even if the stacking height increases in this manner, an increment in the stacking height due to side curl and bulk may be added to the descent amount of the tray in the related technology.

If the tray is simply caused to descend and a recording medium is discharged thereon, however, the stacking state of the recording media on the tray may possibly be disturbed. If the descent amount of the tray is set too large, or if no side curl or bulk occurs actually, for example, the dropping amount of the recording media until the recording media are stacked on the tray increases. As a result, fluctuation occurs in the dropping direction of each recording medium, thereby increasing the possibility of the stacking state being disturbed.

Furthermore, in an assumption that binding is performed on the recording media with the recording media positioned on the tray, the binding may possibly be performed improperly if the state of the recording media is disturbed.

In other words, in the post-processing apparatus having a binding function, the state of recording media on the tray may influence the quality of the binding. Therefore, simply causing the tray to descend when recording media is discharged may possibly degrade binding performance.

There is a need to provide a post-processing apparatus capable of improving the reliability in discharging recording media onto a tray, and making the state of the recording media on the tray excellent to perform binding on the recording media properly, and an image forming apparatus, such as a copying machine, a facsimile, and a printer, including the post-processing apparatus.

SUMMARY OF THE INVENTION

It is an object of the present invention to at least partially solve the problems in the conventional technology.

In an embodiment, a post-processing apparatus includes: a stacking tray; an upward and downward driving unit; a binding unit; and an upward and downward driving control unit. The upward and downward driving unit drives the stacking tray in upward and downward directions. The binding unit performs binding on recording media whose leading edge is on the stacking tray. The upward and downward driving control unit controls the upward and downward driving unit such that, when the binding unit performs the binding, descent of the stacking tray is performed before a leading edge of a first sheet among the recording media on which the binding is to be performed reaches a position on the stacking tray, and after the leading edge of the first sheet is positioned on the stacking tray, ascent of the stacking tray is performed before a leading edge of a second sheet among the recording media on which the binding is to be performed reaches a position on the stacking tray.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 13A to 13C are schematics of tables used for the operation illustrated in FIGS. 12A and 12B.

DETAILED DESCRIPTION OF THE PREFERRED EMBODIMENTS

Figure 1:
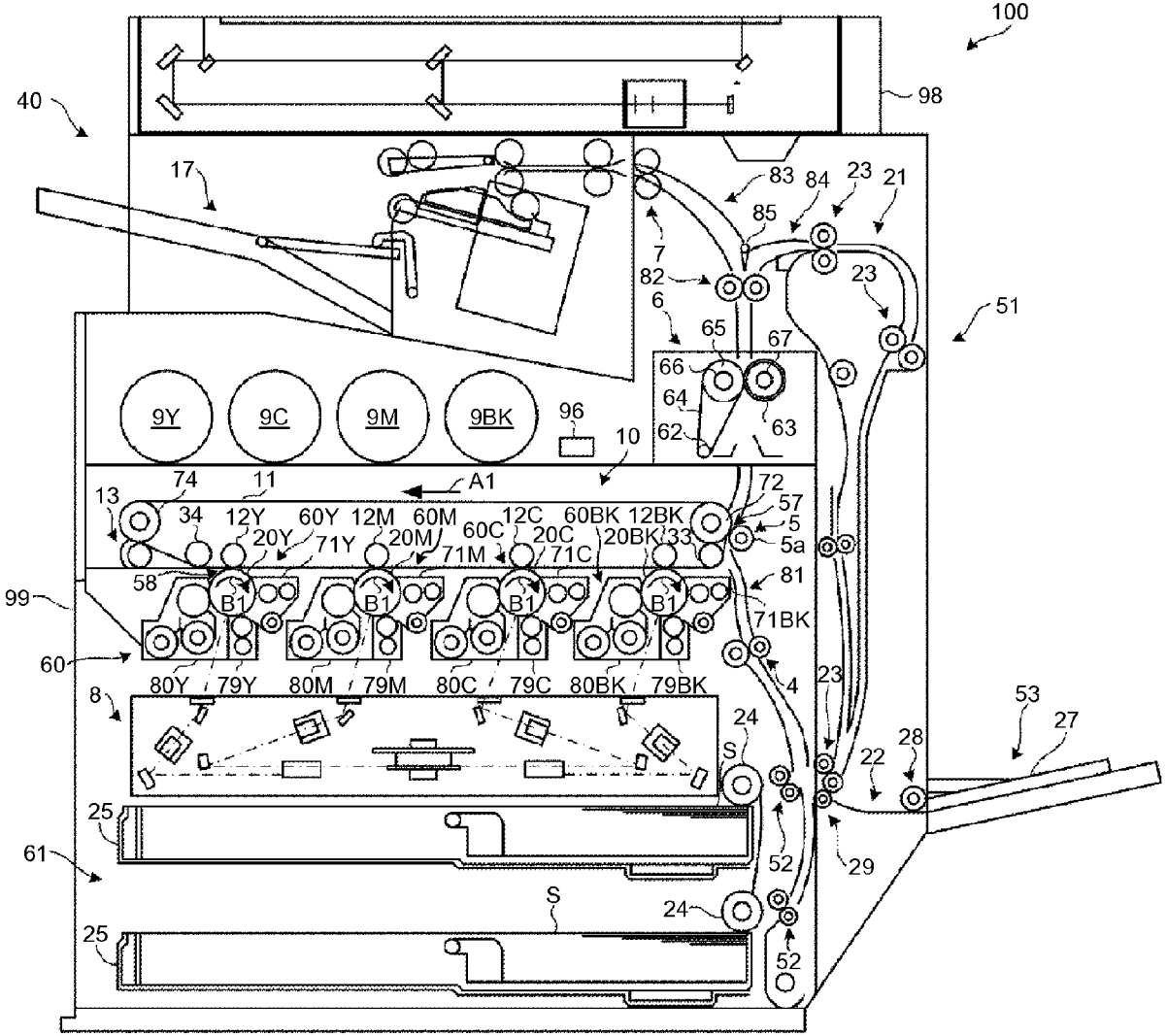
FIG. 1 is a schematic front view of an embodiment of a post-processing apparatus and an image forming apparatus to which the embodiment is applied.

FIG. 1 schematically illustrates an image forming apparatus to which an embodiment is applied. An image forming apparatus 100 is a multifunction peripheral (MFP) of a copying machine, a printer, and a facsimile, and can form a full-color image. Alternatively, the image forming apparatus 100 may be another image forming apparatus, that is, a single item of a copying machine, a printer, and a facsimile, or another MFP such as an MFP of a copying machine and a printer. If the image forming apparatus 100 is used as a printer, the image forming apparatus 100 forms an image based on an image signal corresponding to image information received from an external device, such as a personal computer (PC). The same applies to the case where the image forming apparatus 100 is used as a facsimile.

The image forming apparatus 100 can form an image on any sheet-like recording medium, such as an overhead projector (OHP) sheet, thick paper of a card and a postcard, and an envelope, for example, in addition to plain paper typically used for copying. The image forming apparatus 100 is a duplex image forming apparatus capable of forming images on both sides of a transfer sheet S serving as a recording medium, a sheet, a recording body, and a recording material.

In the image forming apparatus 100, photosensitive elements 20Y, 20M, 20C, and 20BK serving as drum-shaped latent image carriers, latent image carries, and photosensitive elements capable of forming an image corresponding to each color obtained by color separation into yellow, magenta, cyan, and black, are parallelly arranged side by side in a 4-unit tandem manner along a stretching direction of a transfer belt 11 serving as an intermediate transfer body, a transfer body, and an intermediate transfer belt. In other word, the image forming apparatus 100 employs a tandem configuration, that is, a tandem method.

The photosensitive elements 20Y, 20M, 20C, and 20BK are rotatably supported by a frame, which is not illustrated, of a main body 99 functioning as an image forming unit, which is a printer unit of the image forming apparatus 100. The photosensitive elements 20Y, 20M, 20C, and 20BK are arranged in this order from the upstream in an A1 direction, which is a moving direction of the transfer belt 11 and the counterclockwise direction in FIG. 1. Y, M, C, or BK assigned after a number in each reference numeral denotes a member for yellow, magenta, cyan, or black, respectively.

The photosensitive elements 20Y, 20M, 20C, and 20BK are provided to image forming units 60Y, 60M, 60C, and 60BK serving as a plurality of image forming devices and image forming stations for forming an image in yellow (Y), magenta (M), cyan (C), and black (BK), respectively.

The photosensitive elements 20Y, 20M, 20C, and 20BK are positioned on the outer periphery side, that is, on the image forming surface side of the transfer belt 11 configured as an endless belt arranged in the main body 99 in a manner extending in the horizontal direction in FIG. 1.

The transfer belt 11 can move in the arrow A1 direction while facing the photosensitive elements 20Y, 20M, 20C, and 20BK. Visible images, that is, toner images formed and carried on the photosensitive elements 20Y, 20M, 20C, and 20BK are superimposed and transferred onto the transfer belt 11 serving as a transfer medium moving in the arrow A1 direction. Subsequently, the toner images are collectively transferred onto the transfer sheet S. Thus, the image forming apparatus 100 is an image forming apparatus of a tandem-type intermediate transfer method. Therefore, the image forming apparatus 100 is an electrophotographic apparatus serving as a color image forming apparatus of a tandem-type indirect transfer method.

The lower part of the transfer belt 11 faces the photosensitive elements 20Y, 20M, 20C, and 20BK. The facing position, which is the facing part, forms a primary transfer portion 58 serving as a primary transfer area for transferring each of the toner images on the photosensitive elements 20Y, 20M, 20C, and 20BK onto the transfer belt 11.

The superimposing transfer onto the transfer belt 11 is performed such that the toner images formed on the photosensitive elements 20Y, 20M, 20C, and 20BK are superimposed and transferred onto the same position on the transfer belt 11 while the transfer belt 11 is moving in the A1 direction. Specifically, the superimposing transfer is performed by application of a voltage by primary transfer rollers 12Y, 12M, 12C, and 12BK serving as first transfer rollers arranged at positions facing the photosensitive elements 20Y, 20M, 20C, and 20BK, respectively, with the transfer belt 11 interposed therebetween while delaying an operational timing thereof from the upstream to the downstream in the A1 direction.

The transfer belt 11 has a base layer made of polyimide and a discharge prevention layer formed by being coated thereon. Examples of the materials for the base layer include polyamide-imide (PAI). The discharge prevention layer may be made of polyimide similarly to the base layer.

The image forming apparatus 100 includes an image forming unit 60, a transfer belt unit 10, a secondary transfer device 5, and an optical scanning device 8 in the main body 99. The image forming unit 60 is formed of the image forming units 60Y, 60M, 60C, and 60BK serving as four image forming devices, image formation stations, and image forming stations, and is arranged roughly in the center of the main body 99. The transfer belt unit 10 is arranged above the photosensitive elements 20Y, 20M, 20C, and 20BK in a facing manner on the upper side of the image forming unit 60 and serves as an intermediate transfer unit as a transfer unit that is an intermediate transfer device including the transfer belt 11. The secondary transfer device 5 is arranged in a manner facing the transfer belt 11 on the right side thereof in FIG. 1. The optical scanning device 8 serving as a latent image forming unit, an optical writing unit, an optical writing unit, an optical unit, a writing device, and an exposing unit is arranged below the image forming units 60Y, 60M, 60C, and 60BK in a facing manner, and is adjacent to the lower part of the image forming unit 60.

The image forming apparatus 100 further includes a sheet feeding device 61, a pair of registration rollers 4, and a sensor. The sheet feeding device 61 is arranged below the optical scanning device 8 in the main body 99 and serves as a paper feeder that is a paper feeding device or a paper feed tray as a paper feeding unit on which a number of transfer sheets S can be stacked to be conveyed to a secondary transfer portion 57 that is an intermediate transfer portion, serving as a secondary transfer area, between the transfer belt 11 and the secondary transfer device 5. The pair of registration rollers 4 serving as carriage rollers feed the transfer sheet S picked up in the sheet feeding device 61 and conveyed therefrom to the secondary transfer portion 57 at a predetermined timing corresponding to the operational timing at which the toner image is formed by the image forming units 60Y, 60M, 60C, and 60BK. The sensor, which is not illustrated, detects that the leading edge of the transfer sheet S reaches the pair of registration rollers 4.

The image forming apparatus 100 further includes a fixing device 6, ejecting rollers 7, and toner bottles 9Y, 9M, 9C, and 9BK in the main body 99. The fixing device 6 serving as a fixing unit of a belt fixing method and a fixing unit fixes the toner image transferred onto the transfer sheet S on the transfer sheet S. The ejecting rollers 7 serving as discharging rollers, a pair of ejecting rollers, and a discharging device discharge the transfer sheet S on which the image is fixed to the outside of the main body 99. The toner bottles 9Y, 9M, 9C, and 9BK are arranged above the transfer belt unit 10, and are filled with toner in each of yellow, magenta, cyan, and black, respectively.

The image forming apparatus 100 further includes a duplex unit 51, a scanning device 98, and a post-processing apparatus 40. The duplex unit 51 is attached to the right side of the main body 99 in FIG. 1. The scanning device 98 is arranged on the upper side of the main body 99 and serves as an image scanning device that is an image scanning unit as a scanner for scanning an original. The post-processing apparatus 40 is arranged on the upper left side of the main body 99 and below the scanning device 98 in FIG. 1. The post-processing apparatus 40 serves as a post-processer that is a post-processing unit on which the transfer sheets S discharged to the outside of the main body 99 by the ejecting rollers 7 are stacked after undergoing a shift operation and a stapling operation as post-processing.

The image forming apparatus 100 further includes a sheet conveying path 81, bifurcating carriage rollers 82, a discharge path 83, a re-feed path 84, and a bifurcating claw 85 in the main body 99. The sheet conveying path 81 serving as a vertical conveying path and a recording material conveying path is formed upward on the right side in FIG. 1, is provided with the secondary transfer portion 57, the pair of registration rollers 4, and the fixing device 6 in the middle thereof, and introduces the transfer sheet S fed from the sheet feeding device 61 thereinto. The bifurcating carriage rollers 82 is arranged on the downstream of the fixing device 6 in the conveying direction of the transfer sheet S in the sheet conveying path 81, is positioned at the downstream end of the sheet conveying path 81 in the conveying direction, and applies power to go forward for further conveying the transfer sheet S on which the image is fixed. The discharge path 83 is connected to the downstream end in a manner bifurcating into two directions so as to convey the transfer sheet S toward the ejecting rollers 7 or the duplex unit 51 from the downstream end. The re-feed path 84 serves as a duplex conveying path. The bifurcating claw 85 can switch positions so as to introduce the transfer sheet S conveyed by the bifurcating carriage rollers 82 arranged in the vicinity and on the upstream thereof in the conveying direction into one of the discharge path 83 and the re-feed path 84.

The image forming apparatus 100 further includes a driving device and a control unit 96 in the main body 99. The driving device, which is not illustrated, drives to rotate the photosensitive elements 20Y, 20M, 20C, and 20BK. The control unit 96 includes a central processing unit (CPU), memory, and the like, which are not illustrated, for controlling entire operations of the image forming apparatus 100.

The image forming apparatus 100 further includes a start switch and an operation panel on the exterior surface of the main body 99. With the start switch and the like, which are not illustrated, for inputting an image formation start instruction, it is possible to specify an operation and an operating aspect of the image forming apparatus 100. The operation panel, which is not illustrated, includes a liquid crystal display (LCD), which is not illustrated, serving as a display unit for performing predetermined display.

In addition to the transfer belt 11, the transfer belt unit 10 includes the primary transfer rollers 12Y, 12M, 12C, and 12BK, a driving roller 72, a cleaning facing roller 74, and stretching rollers 33 and 34. The primary transfer rollers 12Y, 12M, 12C, and 12BK serve as transfer bias applying members and primary transfer bias rollers. The driving roller 72 serves as a supporting roller supporting the transfer belt 11 rotatably, one of a plurality of rollers around which the transfer belt 11 is stretched, and a driving member. The cleaning facing roller 74 serves as a stretching roller. The stretching rollers 33 and 34 stretch the transfer belt 11 therearound together with the driving roller 72 and the cleaning facing roller 74.

The transfer belt unit 10 further includes a cleaning device 13 and a driving system. The cleaning device 13 serving as an intermediate transfer body cleaning device and a belt cleaning device is arranged at a position facing the cleaning facing roller 74 in a manner facing the transfer belt 11, and cleans the surface of the transfer belt 11. The driving system, which is not illustrated, drives to rotate the driving roller 72.

The transfer belt unit 10 further includes a power source serving as a bias applying unit and a bias control unit realized as a function of the control unit 96, neither of which is illustrated. The power source and the bias control unit apply primary transfer bias, which is transfer bias having the same polarity as the charged polarity of the toner, to the primary transfer rollers 12Y, 12M, 12C, and 12BK, cause the primary transfer rollers 12Y, 12M, 12C, and 12BK to function as repulsive rollers serving as primary transfer units and transfer units, and constitute the primary transfer device together with the primary transfer rollers 12Y, 12M, 12C, and 12BK.

The cleaning facing roller 74 and the stretching rollers 33 and 34 are driven rollers that are dragged to rotate by the transfer belt 11 driven to rotate by the driving roller 72. The primary transfer rollers 12Y, 12M, 12C, and 12BK presses the transfer belt 11 against the photosensitive elements 20Y, 20M, 20C, and 20BK, respectively, from the back surface thereof, thereby forming primary transfer nips. The primary transfer nips are formed at a section of the transfer belt 11 stretched between the stretching roller 33 and the stretching roller 34 nearly horizontally. The stretching roller 33 functions as a transfer entrance roller that introduces the transfer sheet S conveyed from the registration rollers 4 into the secondary transfer portion 57.

The cleaning facing roller 74 is a member also functioning as a pressing member and a tension roller that applies predetermined tension suitable for transfer to the transfer belt 11.

The cleaning facing roller 74 and the stretching rollers 33 and 34 have a function to stabilize the primary transfer nips.

In each of the primary transfer nips, a primary transfer electric field is formed between the photosensitive elements 20Y, 20M, 20C, and 20BK and the primary transfer rollers 12Y, 12M, 12C, and 12BK, respectively, by the action of the primary transfer bias. The toner image in each color formed on the photosensitive elements 20Y, 20M, 20C, and 20BK is primarily transferred onto the transfer belt 11 electrostatically by influences of the primary transfer electric field and the nip pressure.

The driving roller 72 abuts on the secondary transfer device 5 with the transfer belt 11 interposed therebetween, and forms the secondary transfer portion 57.

As will be described later, secondary transfer bias, which is transfer bias having the same polarity as the charged polarity of the toner, is applied to the driving roller 72. As a result, the driving roller 72 functions as a repulsive roller serving as a secondary transfer unit and a transfer unit.

The cleaning device 13 is arranged on the lower left side of the transfer belt unit 10 in FIG. 1, more specifically, below the cleaning facing roller 74. The cleaning device 13 includes a cleaning member arranged in a manner abutting on the transfer belt 11 at a position facing the cleaning facing roller 74, a case housing the cleaning member therein, and a waste toner collection bottle serving as a toner housing container arranged on the front side of the case in FIG. 1, none of which is illustrated.

The cleaning device 13 causes the cleaning member to scrape off and remove a foreign body such as residual toner on the transfer belt 11, thereby cleaning the transfer belt 11. The foreign body removed from the transfer belt 11 is accumulated in the waste toner collection bottle. The waste toner collection bottle can be extracted to the front side in FIG. 1 with a front panel open, and can be replaced by a new one when the waste toner collection bottle is filled with the foreign body. Cleaning devices 71Y, 71M, 71C, and 71BK, which will be described later, also include replaceable waste toner collection bottles similar thereto.

The sheet feeding device 61 houses a bundle of transfer sheets obtained by stacking a plurality of transfer sheets S, and is arranged below the optical scanning device 8 in the lower part of the main body 99. The sheet feeding device 61 includes a paper cassette 25, a feeding roller 24, and a separating roller 52. The paper cassette 25 serving as a paper feed tray can house a bundle of transfer sheets S, and is provided in plurality, two in the present embodiment, in a manner being stacked in the vertical direction. The feeding roller 24 serving as a pick-up roller and a paper feeding roller abuts on the upper surface of the uppermost transfer sheet S among the transfer sheets S stacked in the paper cassette 25. The separating roller 52 serving as a paper feeding carriage roller separates the transfer sheets S fed by the feeding roller 24 into one sheet, and feeds and conveys the transfer sheet S upward along the sheet conveying path 81. The feeding roller 24 is driven to rotate in the counterclockwise direction at a predetermined timing, thereby feeding the uppermost transfer sheet S to the pair of registration rollers 4.

In the sheet feeding device 61, the feeding roller 24 is selectively driven to rotate in the counterclockwise direction in FIG. 1, and the separating roller 52 operates, whereby the uppermost transfer sheet S among the transfer sheets S stacked in the paper cassette 25 is introduced into the sheet conveying path 81, and is fed to the pair of registration rollers 4. The transfer sheet S thus conveyed then abuts on the nip of the pair of registration rollers 4, and stops in a manner being nipped therebetween.

The secondary transfer device 5 is arranged in a manner facing the driving roller 72. The secondary transfer device 5 includes a secondary transfer roller 5*a*, and a power source serving as a bias applying unit and a bias control unit realized as a function of the control unit 96, neither of which is illustrated. The secondary transfer roller 5*a* serving as a transfer bias applying member faces the driving roller 72 with the transfer belt 11 interposed therebetween, and is arranged in a manner being pressed against the driving roller 72. The power source and the bias control unit apply the secondary transfer bias, which is transfer bias having the same polarity as the charged polarity of the toner, to the driving roller 72, and cause the driving roller 72 to function as a component of the secondary transfer device 5.

The secondary transfer device 5 secondarily transfers the toner image on the transfer belt 11 onto the transfer sheet S by the secondary transfer roller 5*a*. In addition, the secondary transfer device 5 has a sheet conveying function to convey the transfer sheet S onto which the toner image is transferred by the secondary transfer to the fixing device 6.

The power source serving as the bias applying unit and the bias control unit may apply the secondary transfer bias, which is transfer bias, not to the driving roller 72, but to the secondary transfer roller 5*a*. In this case, the secondary transfer bias applied to the secondary transfer roller 5*a* has the same polarity as the charged polarity of the toner, and the secondary transfer roller 5*a* functions as an attractive roller serving as a secondary transfer unit and a transfer unit.

The duplex unit 51 includes a reverse conveying path 21, a bypass feeding device 53, a bypass feeding path 22, and carriage rollers 23. The reverse conveying path 21 reverses and conveys the transfer sheet S passing through the re-feed path 84 toward a position on the upstream of the pair of registration rollers 4 in the conveying direction of the transfer sheet S in the sheet conveying path 81. The bypass feeding path 22 extends from the bypass feeding device 53 in a manner traversing inside of the duplex unit 51, and is connected to the reverse conveying path 21. The carriage rollers 23 are arranged in the reverse conveying path 21, and convey the transfer sheet S to the sheet conveying path 81.

The duplex unit 51 reverses the transfer sheet S with an image formed on one side in the reverse conveying path 21, and conveys the transfer sheet S thus reversed to the pair of registration rollers 4 so as to form an image on the other side of the transfer sheet S.

The bypass feeding device 53 includes a bypass tray 27, a feeding roller 28, and a separating roller 29. The bypass tray 27 serves as a bypass feed tray on which transfer sheets S can be stacked The feeding roller 28 serving as a paper feeding roller abuts on the upper surface of the uppermost transfer sheet among the transfer sheets S stacked on the bypass tray 27. The separating roller 29 separates the transfer sheets fed by the feeding roller 28 into one sheet.

In the bypass feeding device 53, the feeding roller 28 is driven to rotate in the clockwise direction in FIG. 1, and the separating roller 29 operates, whereby the uppermost transfer sheet S is fed to the pair of registration rollers 4. The transfer sheet S thus conveyed then abuts on the nip of the pair of registration rollers 4, and stops in a manner being nipped therebetween.

The fixing device 6 includes a fixing belt 64, a fixing roller 65, a tension roller 62, a pressing roller 63, a halogen heater 66, a halogen heater 67, and a spring. The fixing belt 64 serving as a fixing member is formed in an endless belt shape. The fixing roller 65 stretches the fixing belt 64 therearound. The tension roller 62 also stretches the fixing belt 64 therearound together with the fixing roller 65, and keeps the tension of the fixing belt 64 constant. The pressing roller 63 serving as a pressing member forms a fixing nip functioning as a nip portion and a fixing portion that nips the fixing belt 64 and presses the transfer sheet S with the fixing roller 65. The halogen heater 66 serving as a first heating unit and a first heat source is arranged inside the fixing roller 65, and heats up the fixing belt 64 via the fixing roller 65. The halogen heater 67 serving as a second heating unit and a second heat source heats up the pressing roller 63. The spring, which is not illustrated, serves as a biasing unit for forming the fixing nip.

The fixing belt 64 is made of polyimide, which has high heat resistance and high durability, and has a thickness of tens of microns. One of the rotating shafts of the fixing roller 65 and the pressing roller 63 is fixed, whereas the other of the rotating shafts is supported in a movable manner. As a result, a second roller can be brought into contact with and separated from a first roller. By basing the second roller with the spring, the fixing nip is formed between the fixing roller 65 and the pressing roller 63 with the fixing belt 64 interposed therebetween. The tension roller 62, the fixing belt 64, and the fixing roller 65 constitute a belt unit in which the fixing belt 64 moves endlessly.

In the fixing device 6, by causing the transfer sheet S on which the toner image is carried to pass through the fixing nip in a manner being nipped, the toner image thus carried is fixed onto the surface of the transfer sheet S by the action of heat and pressure.

The toner in each of yellow, magenta, cyan, and black in the toner bottles 9Y, 9M, 9C, and 9BK, respectively, is polymerized toner. The toner bottles 9Y, 9M, 9C, and 9BK are rotated by a driving unit, which is not illustrated, thereby ejecting the toner. The toner then passes through a conveying path formed of a pipe or the like, which is not illustrated, and is supplied to developing units 80Y, 80M, 80C, and 80BK included in the image forming units 60Y, 60M, 60C, and 60BK, respectively, by a predetermined supply amount as will be described later.

The scanning device 98 includes an exposure glass, a light source, a first running body, a second running body, an imaging lens, and a scanning sensor, and the like, none of which is illustrated in detail. The exposure glass is a glass on which an original is placed. The light source irradiates the original placed on the exposure glass with light. The first running body includes a first reflector that reflects the light output from the light source and reflected on the original, and runs in the horizontal direction in FIG. 1. The second running body includes a second reflector that reflects the light reflected by the reflector of the first running body. The imaging lens images the light from the second running body. The scanning sensor receives the light passing through the imaging lens, and scans the image on the surface of the original, thereby scanning the content of the original.

Based on image information corresponding to the content of the original scanned by the scanning device 98, or image data used for performing optical writing on the photosensitive elements 20Y, 20M, 20C, and 20BK, the image data being generated by the control unit 96 based on image information received from an external device such as a PC, the optical scanning device 8 irradiates the photosensitive elements 20Y, 20M, 20C, and 20BK with laser light, thereby scanning the photosensitive elements 20Y, 20M, 20C, and 20BK.

Figure 2:
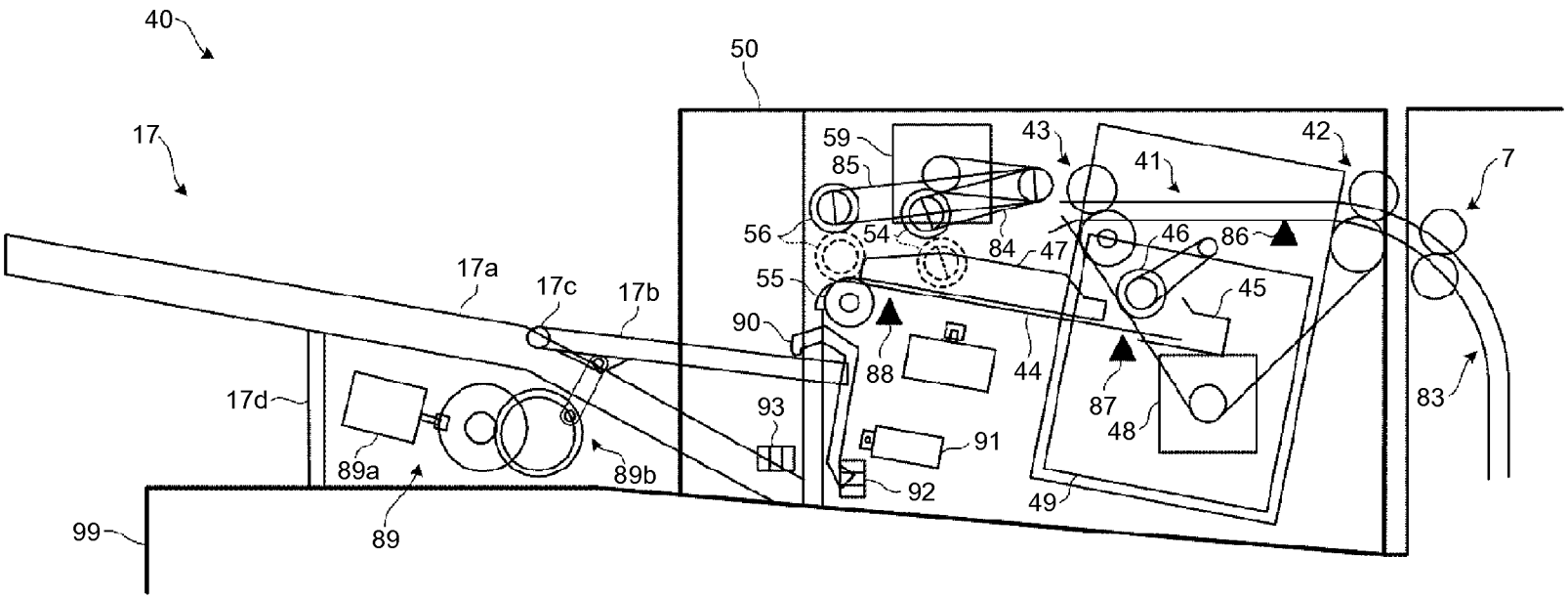
FIG. 2 is a schematic front sectional view of the post-processing apparatus illustrated in FIG. 1 and the periphery thereof.
Figure 3:
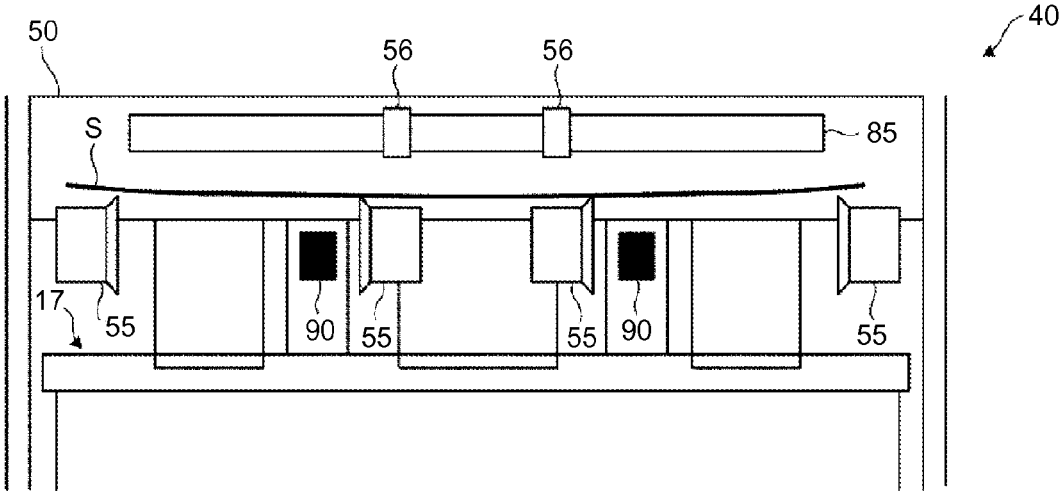
FIG. 3 is a schematic side sectional view of a part of the post-processing apparatus illustrated in FIG. 1.

As illustrated in FIG. 2 or FIG. 3, the post-processing apparatus 40 includes a discharge conveying path 41, a pair of entrance rollers 42, and a pair of shift discharging rollers 43 in a main body 50. The discharge conveying path 41 extends along the conveying direction of the transfer sheet S from the left side to the right side in FIG. 2, that is, toward the front side in FIG. 3, and receives the transfer sheet S on which an image is formed and that is discharged to the outside of the main body 99 by the ejecting rollers 7. The pair of entrance rollers 42 serving as a first conveying unit conveys the transfer sheet S entering the discharge conveying path 41. The pair of shift discharging rollers 43 serving as a second conveying unit can further convey the transfer sheet S conveyed by the pair of entrance rollers 42. In addition, the pair of shift discharging rollers 43 serving as a shift processing unit, a shift unit, and a pair of shift conveying rollers shifts the transfer sheet S in the width direction of the transfer sheet S, which is a perpendicular direction with respect to the surface of FIG. 2, that is, in the horizontal direction in FIG. 3, and discharges the transfer sheet S.

The post-processing apparatus 40 further includes a staple tray 44, a trailing edge reference fence 45, a returning roller 46, and a jogger fence 47 in the main body 50. The transfer sheets S passing through the pair of shift discharging rollers 43 are temporarily stacked on the staple tray 44. The trailing edge reference fence 45 is positioned on the trailing edge side of each transfer sheet S stacked on the staple tray 44. The returning roller 46 is arranged above the staple tray 44 and the trailing edge reference fence 45, and rotates to cause the trailing edge of each transfer sheet S stacked on the staple tray 44 to abut on the trailing edge reference fence 45. The jogger fence 47 functions as an aligning plate positioned on each end side in the width direction of the transfer sheets S stacked on the staple tray 44.

The post-processing apparatus 40 further includes an entrance motor 48 and a stapler 49 in the main body 50. The entrance motor 48 serving as a first driving unit and a stepping motor drives the pair of entrance rollers 42 and the pair of shift discharging rollers 43. The stapler 49 serving as a staple processing unit, a stapling unit, and a binding unit performs binding, that is, stapling on transfer sheets S stacked on the staple tray 44.

The post-processing apparatus 40 further includes a tapping roller 54, a discharging roller 55, a driven roller 56, and a discharging motor 59 in the main body 50. The tapping roller 54 is arranged on the downstream of the returning roller 46 in the conveying direction of the transfer sheets S, and rotates to cause the trailing edge of the transfer sheets S stacked on the staple tray 44 to abut on the trailing edge reference fence 45. The discharging roller 55 discharges the transfer sheets S stacked on the staple tray 44 toward the downstream in the conveying direction of the transfer sheets S from the staple tray 44. The driven roller 56 is brought into contact with and separated from the discharging roller 55. The discharging motor 59 serves as a stepping motor that is a second driving unit selectively driving the tapping roller 54 and the discharging roller 55.

The post-processing apparatus 40 further includes a lever 84 and a lever 85, an entrance sensor 86, a paper presence sensor 87, and a bundle discharging sensor 88 in the main body 50. The lever 84 and the lever 85 support the tapping roller 54 and the driven roller 56, respectively, on each tip in a rotatable manner, and displace the rollers in upward and downward directions. The entrance sensor 86 detects the leading edge and the trailing edge of each transfer sheet S in the discharge conveying path 41 in relation to the detection timing. The paper presence sensor 87 detects presence of the transfer sheets S stacked on the staple tray 44. The bundle discharging sensor 88 is arranged on the downstream of the paper presence sensor 87 in the conveying direction of the transfer sheets S, and detects a passing timing of the trailing edge of the transfer sheets S stacked on the staple tray 44.

The post-processing apparatus 40 further includes a discharge tray 17 and an upward and downward driving unit 89.

The discharge tray 17 serving as a stack tray, a part of which on the base end side is positioned inside the main body 50, receives the transfer sheets S discharged from the staple tray 44 by rotation of the discharging roller 55, whereby the transfer sheets S are stacked thereon. The upward and downward driving unit 89 drives the discharge tray 17 in upward and downward directions.

The post-processing apparatus 40 further includes a sheet holder 90, a solenoid 91, a tray paper surface detection sensor 92, and a discharge tray fullness sensor 93 in the main body 50. The sheet holder 90 holds down the transfer sheets S stacked on the discharge tray 17 with the tip thereof abutting on the upper surface of the end on the upstream side in the conveying direction, that is, on the upper surface of the trailing edge of the uppermost transfer sheet S among the transfer sheets S stacked on the discharge tray 17. The solenoid 91 serving as a push solenoid allows the sheet holder 90 to swing when the solenoid 91 is turned OFF, thereby enabling the holding operation performed by the sheet holder 90. In addition, the solenoid 91 prevents the sheet holder 90 from swinging when the solenoid 91 is turned ON, thereby disabling the holding operation performed by the sheet holder 90. The tray paper surface detection sensor 92 inputs a signal related to the detection state whether the base end of the sheet holder 90 is detected when the solenoid 91 is turned OFF to the control unit 96, and causes the upward and downward driving unit 89 to move the discharge tray 17 upward and downward depending on the detection state. The discharge tray fullness sensor 93 detects the fullness of the transfer sheets S on the discharge tray 17.

The post-processing apparatus 40 further includes a shift motor and a roller displacement stepping motor, neither of which is illustrated. The shift motor serving as a stepping motor shifts the pair of shift discharging rollers 43 in a shift direction parallel to the width direction of the transfer sheet S. The roller displacement stepping motor causes the lever 84 and the lever 85 to swing synchronously, thereby displacing the tapping roller 54 and the driven roller 56 in upward and downward directions synchronously.

The post-processing apparatus 40 further includes a post-processing control unit realized as a function of the control unit 96. Based on detection of the leading edge and the trailing edge of the transfer sheet S by the entrance sensor 86 and the bundle discharging sensor 88, detection of the fullness by the discharge tray fullness sensor 93, and these detection timings, the post-processing control unit performs control for determining an input timing of a pulse to be input to the entrance motor 48, the discharging motor 59, the shift motor, and the roller displacement stepping motor. Furthermore, by controlling the number of driving steps in the pulse, the post-processing control unit controls an operation, such as a shift operation and a stapling operation, for performing processing on the transfer sheet S in the post-processing apparatus 40 and entire operations of the post-processing apparatus 40 in addition to the operation described above.

The discharge conveying path 41 is communicated with the discharge path 83. The pair of entrance rollers 42 and the pair of shift discharging rollers 43 are arranged in this order from the upstream to the downstream in the conveying direction of the transfer sheet S in the discharge conveying path 41.

The pair of shift discharging rollers 43 is provided to the end on the most downstream side in the conveying direction of the transfer sheet S in the discharge conveying path 41. The pair of shift discharging rollers 43 is caused to reciprocate in the width direction of the transfer sheet S, that is, in a direction perpendicular to the conveying direction of the transfer sheet S by the shift motor.

The discharge conveying path 41, the pair of entrance rollers 42, the pair of shift discharging rollers 43, and the entrance motor 48 constitute a sheet receiving unit. The sheet receiving unit conveys the transfer sheet S received by the pair of entrance rollers 42 from the discharge path 83 to the pair of shift discharging rollers 43 in the discharge conveying path 41, and conveys the transfer sheet along the discharge conveying path 41 by causing the pair of entrance rollers 42 and the pair of shift discharging rollers 43 to rotate by the entrance motor 48.

The tapping roller 54 is arranged between the pair of shift discharging rollers 43 and the discharging roller 55 in the conveying direction of the transfer sheet S. The tapping roller 54 is rotated in a direction of conveying the transfer sheet S toward the upstream in the conveying direction by the discharging motor 59, and causes the transfer sheet S to switchback until the transfer sheet S abuts on the trailing edge reference fence 45 on the staple tray 44.

The returning roller 46 is arranged on the downstream of the tapping roller 54 in the direction in which the tapping roller 54 causes the transfer sheet S to switchback. The returning roller 46 assists the conveyance, that is, the switchback of the transfer sheet S performed by the tapping roller 54 on the staple tray 44. In addition, the returning roller 46 causes the trailing edge of each transfer sheet S stacked on the staple tray 44 to abut on the trailing edge reference fence 45, thereby aligning the transfer sheet S in the conveying direction. Therefore, the trailing edge reference fence 45 functions as a reference of alignment of the transfer sheet S on the staple tray 44 in the conveying direction of the transfer sheet S with the transfer sheet S abutting thereon.

By contrast, the jogger fence 47 functions as a reference of alignment of the transfer sheet S on the staple tray 44 in the width direction of the transfer sheet S. Specifically, in the jogger fence 47, one end is a fixed portion and the other end is a movable portion that is displaced in the width direction of the transfer sheet S. In the state where the returning roller 46 aligns the transfer sheet S in the conveying direction on the staple tray 44, the movable portion is displaced in the width direction of the transfer sheet S, and sandwiches the transfer sheet S with the fixed portion. As a result, the fixed portion and the movable portion abut on the side edges of the transfer sheet S, respectively. Thus, the jogger fence 47 adjusts the transfer sheet S on the staple tray 44 to a predetermined reference position in the width direction, thereby performing alignment.

As described above, the trailing edge reference fence 45 functions as a first alignment unit and a conveying direction alignment unit that aligns the transfer sheet S in the conveying direction. By contrast, the jogger fence 47 functions as a second alignment unit and a width direction alignment unit that aligns the transfer sheet S in the width direction. Furthermore, the trailing edge reference fence 45 and the jogger fence 47 function as an alignment unit that aligns the transfer sheet S.

The stapler 49 binds a plurality of transfer sheets S, that is, a bundle of the transfer sheets S aligned in the conveying direction and the width direction on the staple tray 44. Therefore, if a specific number of transfer sheets S are aligned in the conveying direction and the width direction on the staple tray 44, the stapler is displaced toward a stitching position of a staple, and performs stapling, that is, binding using a staple in the vicinity of one side edge on the trailing edge of the transfer sheets S.

The distance from the pair of shift discharging rollers 43 to the discharging roller 55 and the distance from the trailing edge reference fence 45 to the discharging roller 55 are set smaller than the length of a transfer sheet S whose length in the conveying direction is the smallest among the transfer sheets S on which the post-processing apparatus 40 can perform the post-processing by the stapling operation. In other words, the distances are set smaller than the length of the transfer sheet S whose length in the conveying direction is the smallest among the transfer sheets S on which the image forming apparatus 100 forms an image, that is, among the transfer sheets S that pass through the post-processing apparatus 40, and on which the post-processing apparatus 40 can perform the post-processing.

Therefore, when the transfer sheet S switchbacks on the staple tray 44, and when the stapler 49 performs the stapling operation, that is, the binding operation on the bundle of the transfer sheets S, a part of the leading edge of each transfer sheet S in the moving direction toward the discharge tray 17 passes by the discharging roller 55, and reaches a space above the discharge tray 17. In this state, the part of the transfer sheet S may come into contact with the upper surface of the discharge tray 17 or with the upper surface of the uppermost transfer sheet S among the transfer sheets S stacked on the discharge tray 17. Alternatively, the part of the transfer sheet S may be separated from the upper surfaces. In any case, the part of the transfer sheet S is positioned above the discharge tray 17.

The discharging roller 55 and the driven roller 56 are arranged positions just before the position at which the transfer sheet S is discharged onto the discharge tray 17 in the conveying direction of the transfer sheet S. The discharging roller 55 is rotated in a direction of conveying the transfer sheets S toward the downstream in the conveying direction by the discharging motor 59.

The tapping roller 54 and the discharging roller 55 are not rotated by the discharging motor 59 simultaneously. While one of the rollers is rotating, the other stops rotating.

The driven roller 56 is dragged to rotate by rotation of the discharging roller 55 when coming into contact with the discharging roller 55.

If the discharging motor 59 drives in the state where the lever 85 is displaced downward by the roller displacement stepping motor, and the driven roller 56 comes into contact with the discharging roller 55, the driven roller 56 is dragged to rotate by the discharging roller 55. Furthermore, if the discharging motor 59 drives in the state where the transfer sheet S is nipped between the discharging roller 55 and the driven roller 56, the discharging roller 55 discharges the transfer sheet S onto the discharge tray 17 on which transfer sheets S are stacked.

When the solenoid 91 is turned OFF, the sheet holder 90 swings such that the tip thereof tilts toward the discharge tray 17 because of moment caused by its own weight. As a result, the sheet holder 90 holds down the upper surface of the uppermost transfer sheet S placed on the discharge tray 17 with the tip.

The solenoid 91 performs a sheet holding operation in which the solenoid 91 is separated from the sheet holder 90 by being turned OFF. More specifically, the solenoid 91 allows the sheet holder 90 to swing, thereby enabling the holding operation performed by the sheet holder 90. In addition, the solenoid 91 performs a sheet holding cancelling operation in which the solenoid 91 abuts on the sheet holder 90 to restore the sheet holder 90 from the tilted state by being turned ON. More specifically, the solenoid 91 prevents the sheet holder 90 from swinging, thereby disabling the holding operation performed by the sheet holder 90.

The discharge tray 17 is positioned on the most downstream side in the conveying direction of the transfer sheet S in the image forming apparatus 100. The discharge tray 17 includes a fixed tray portion 17*a*, a movable tray portion 17*b*, and a support shaft 17*c*. The fixed tray portion 17*a* extends in the conveying direction of the transfer sheet S, inclines such that the tip thereof is directed upward, and is fixed to the main body 50 and the main body 99. In the movable tray portion 17*b*, the base end is rotatably supported by a middle portion of the fixed tray portion 17*a* in the conveying direction of the transfer sheet S, and a part of the tip is positioned inside the main body 50. The support shaft 17*c* rotatably supports the base end of the movable tray portion 17*b* on the fixed tray portion 17*a*.

The discharge tray 17 further includes a support 17*d* that supports the fixed tray portion 17*a* from below on the downstream of the support shaft 17*c* in the width direction of the transfer sheet S so as to support the tip of the fixed tray portion 17*a*.

The movable tray portion 17*b* is arranged in a manner overlapping the fixed tray portion 17*a* at a position from the middle portion to the upstream end of the fixed tray portion 17*a* in the conveying direction of the transfer sheet S. In the movable tray portion 17*b*, the base end swingably supported by the support shaft 17*c* functions as a hinged end, and the tip is supported in a manner descendible until the tip abuts on the base end of the fixed tray 17*a*.

In the support 17*d*, the lower end is fixed to the main body 99 and is supported from below, and the upper end supports the fixed tray 17*a* from below. Therefore, even if the stacking amount of the transfer sheets S on the discharge tray 17 increases, deformation of the fixed tray portion 17*a* is prevented and suppressed, whereby the transfer sheets S are prevented from collapsing. Furthermore, the support 17*d* forms a space that houses the upward and downward driving unit 89 together with the main body 99 and the fixed tray portion 17*a* so as to prevent the upward and downward driving unit 89 from being exposed.

As illustrated in FIG. 1, the discharge tray 17 is positioned above the main body 99 and below the scanning device 98. Therefore, the image forming apparatus 100 is an in-body paper discharging type image forming apparatus. The post-processing apparatus 40 is attachable to and detachable from the main body 99. If the post-processing apparatus 40 is removed, the upper left surface of the main body 99 in FIG. 1 functions as a discharge tray that receives the transfer sheets S on which an image is formed and that is discharged to the outside of the main body 99 by the ejecting rollers 7, whereby the transfer sheets S are stacked on the tray.

As illustrated in FIG. 2, the upward and downward driving unit 89 includes a tray direct-current (DC) motor 89*a* serving as a driving source, and a cam and link mechanism 89*b* serving as a transfer mechanism that transfers the driving force of the tray DC motor 89*a* to the movable tray portion 17*b*. Drive of the tray DC motor 89*a* is controlled by the control unit 96 functioning as the post-processing control unit. A moving end of the cam and link mechanism 89*b* is connected to the lower surface of the movable tray portion 17*b*, and transfers the driving force of the tray DC motor 89*a* to the movable tray portion 17*b*. With this configuration, in the movable tray portion 17*b*, the tip that is a free end rotates about the base end supported by the support shaft 17*c*, whereby the tip swings in a manner displaced in upward and downward directions.

As a result, the position of the trailing edge of each transfer sheet S stacked on the discharge tray 17 moves upward and downward. In this respect, the control unit 96 functioning as the post-processing control unit functions as an upward and downward driving control unit that controls the operation of the upward and downward driving unit 89 and controls the upward and downward movement of the discharge tray 17.

In the upward and downward driving unit 89, when the solenoid 91 is turned OFF, and the base end of the sheet holder 90 is not detected by the tray paper surface detection sensor 92, the control unit 96 functioning as the post-processing control unit and the upward and downward driving control unit controls drive of the tray DC motor 89*a* such that the movable tray portion 17*b* is caused to ascend until the base end of the sheet holder 90 is detected by the tray paper surface detection sensor 92.

Furthermore, in the upward and downward driving unit 89, on condition that the solenoid 91 is turned OFF, and the base end of the sheet holder 90 is detected by the tray paper surface detection sensor 92, the control unit 96 functioning as the post-processing control unit and the upward and downward driving control unit controls drive as follows: the movable tray portion 17*b* is caused to descend temporarily until the base end of the sheet holder 90 is not detected by the tray paper surface detection sensor 92; and thereafter the movable tray portion 17*b* is caused to ascend until the base end of the sheet holder 90 is detected by the tray paper surface detection sensor 92.

Therefore, in the discharge tray 17, when the solenoid 91 is turned OFF, the movable tray portion 17*b* is driven by the upward and downward driving unit 89 based on detection of the tray paper surface detection sensor 92 under control of the control unit 96 functioning as the post-processing control unit and the upward and downward driving control unit such that the position of the transfer sheet S placed uppermost, especially, the position of the upper surface of the trailing edge thereof is made constant. The upward and downward movement of the discharge tray 17, that is, the upward and downward movement of the movable tray portion 17*b* at this time is achieved by causing the tip to rotate about the base end supported by the support shaft 17*c*.

The position at which the upper surface position is made constant is a position set for preventing a transfer sheet S to be discharged onto the discharge tray 17 by the discharging roller 55 from abutting on the transfer sheets S already stacked on the discharge tray 17. Specifically, in the vertical direction, the height from the upper surface position to a nip portion formed by the discharging roller 55 and the driven roller 56 coming into contact with each other is defined as a first height that is necessary and sufficient for preventing such abutment from occurring.

The first height will be described later in greater detail. As is clear the explanation described above, the tray paper surface detection sensor 92 functions as a position detection unit that detects the position of the transfer sheet S positioned uppermost among the transfer sheets S stacked on the discharge tray 17, especially, the position of the upper surface of the portion positioned on the movable tray portion 17*b*. In addition, the control unit 96 functioning as the upper and lower driving control unit controls the upward and downward driving unit 89 such that the position of the uppermost transfer sheet S, especially, the position of the upper surface of the portion positioned on the movable tray portion 17*b* occupies a first position forming the first height.

If transfer sheets S exceeding a predetermined permissible amount are stacked on the discharge tray 17, however, when the fact is detected by the discharge tray fullness sensor 93, the upward and downward movement of the movable tray portion 17*b* is stopped. By detecting that the tip of the movable tray portion 17*b* descends to a position just before a position at which the tip abuts on the base end of the fixed tray 17*a*, the discharge tray fullness sensor 93 detects the fullness state, that is, the state in which the transfer sheets S exceeding the predetermined permissible amount are stacked on the discharge tray 17.

When detecting the tip of the movable tray portion 17*b*, the discharge tray fullness sensor 93 inputs a signal indicating the fullness state to the control unit 96 functioning as the post-processing control unit and the upward and downward driving control unit. When receiving the signal, the control unit 96 functioning as the post-processing control unit and the upward and downward driving control unit stops the descent of the movable tray portion 17*b* even if the solenoid 91 is turned OFF, and the base end of the sheet holder 90 is detected by the tray paper surface detection sensor 92, thereby stopping the upward and downward movement of the movable tray portion 17*b*. Furthermore, when receiving the signal, the control unit 96 functioning as the post-processing control unit causes the LCD of the operation panel to display the fact that the discharge tray 17 is filled with the transfer sheets S, for example. Thus, the control unit 96 causes the LCD of the operation panel to display the fact that the transfer sheets S need to be removed from the discharge tray 17.

With this configuration, the movable tray portion 17*b* is prevented from continuing to descend with the tip thereof abutting on the base end of the fixed tray 17*a*. As a result, it is possible to prevent trouble, such as damage in the discharge tray 17 and the upward and downward driving unit 89, from occurring. Furthermore, because prompt removal of the transfer sheets S from the discharge tray 17 is promoted, it is possible to prevent and suppress reduction in the productivity of the image forming apparatus 100.

The paper presence sensor 87 is provided for detecting in-body remaining paper in the post-processing apparatus 40, more specifically, for detecting presence of a remaining transfer sheet S on the staple tray 44 when the image forming apparatus 100 is turned ON or when a jam occurs in the post-processing apparatus 40.

The image forming units 60Y, 60M, 60C, and 60BK have the same configuration. Specifically, the image forming units 60Y, 60M, 60C, and 60BK include the primary transfer rollers 12Y, 12M, 12C, and 12BK, the cleaning devices 71Y, 71M, 71C, and 71BK, neutralization devices, charging units 79Y, 79M, 79C, and 79BK, and the developing units 80Y, 80M, 80C, and 80BK around the photosensitive elements 20Y, 20M, 20C, and 20BK, respectively, along the outer peripheries of the photosensitive elements 20Y, 20M, 20C, and 20BK in a rotation direction B1, which is the clockwise direction in FIG. 1. The primary transfer rollers 12Y, 12M, 12C, and 12BK serve as process units and the primary transfer units. The cleaning devices 71Y, 71M, 71C, and 71BK serve as cleaners as cleaning units. The neutralization devices, which are not illustrated, serve as neutralizers as neutralization units. The charging units 79Y, 79M, 79C, and 79BK serve as chargers that are charging units for performing alternating current (AC) charging by charging bias. The developing units 80Y, 80M, 80C, and 80BK serve as developing units that are developing units for developing an image by using a two-component developer.

The photosensitive element 20Y, the cleaning device 71Y, the neutralization device, the charging unit 79Y, and the developing unit 80Y are integrally formed as a process cartridge. Similarly, the components around the photosensitive elements 20M, 20C, and 20BK are integrally formed as process cartridges, respectively. The process cartridges are attachable to and detachable from the front side in FIG. 1 in directions of rotating shafts of the photosensitive elements 20Y, 20M, 20C, and 20BK, respectively, with the front panel open. Forming the components as a process cartridge in this manner makes it possible to facilitate the maintenance significantly because such a process cartridge can be handled as a replacement part. Therefore, it is preferable that the components be formed as the process cartridge.

In the image forming apparatus 100 with this configuration, by pressing the start switch, for example, the image forming units 60Y, 60M, 60C, and 60BK perform a following image forming process to form an image.

Specifically, if a signal to form a color image is input, the scanning device 98 scans an original as appropriate to obtain data corresponding to the image to be formed, for example. Furthermore, the driving roller 72 is driven, and the transfer belt 11, the cleaning facing roller 74, and the stretching rollers 33 and 34 are dragged to rotate by the driving roller 72. In addition, the photosensitive elements 20Y, 20M, 20C, and 20BK are driven to rotate in the B1 direction.

Along with rotation in the B1 direction, the surfaces of the photosensitive elements 20Y, 20M, 20C, and 20BK are uniformly charged by the charging units 79Y, 79M, 79C, and 79BK, respectively. Based on image information that is the data corresponding to the image to be formed, exposure scanning is performed with laser light output from the optical scanning device 8 driven by the control unit 96, thereby forming electrostatic latent images corresponding to each of yellow, magenta, cyan, and black. Subsequently, the electrostatic latent images are developed into toner images by the developing units 80Y, 80M, 80C, and 80BK using toner that is an image forming material for forming an image in each of yellow, magenta, cyan, and black contained in the two-component developer, and are developed into images, that is, into visual images. Thus, single-color images formed by the toner images in each of magenta, cyan, and black are formed.

The toner images in each of yellow, magenta, cyan, and black obtained by the development are intermediately transferred onto the same position on the transfer belt 11 rotating in the A1 direction by the primary transfer rollers 12Y, 12M, 12C, and 12BK, respectively. With this transfer, a combined color image is formed on the transfer belt 11.

By contrast, along with the input of the signal to form a color image, one of the feeding roller 24 corresponding to each of the paper cassette 25 and the feeding roller 28 corresponding to the bypass tray 27 is selected, and is driven to rotate, thereby feeding the transfer sheets S. Subsequently, the transfer sheets S are separated into one sheet, and each transfer sheet is conveyed. The transfer sheet S thus conveyed abuts on the pair of registration rollers 4, and stops. To form images on both sides of the transfer sheet S, the transfer sheet S with an image fixed on one side by the fixing device 6 as will be described later is reversed while passing through the reverse conveying path 21. The transfer sheet S then abuts on the pair of registration rollers 4, and stops.

In synchronization with an operational timing at which the combined color image superimposed on the transfer belt 11 moves to the secondary transfer portion 57 by rotation of the transfer belt 11 in the A1 direction, the pair of registration rollers 4 rotate. In the secondary transfer portion 57, the combined color image adheres to the transfer sheet S fed into the secondary transfer portion 57. The combined color image is then secondarily transferred onto the transfer sheet S by the action of nip pressure and electrostatic transfer, and is recorded thereon.

The transfer sheet S is conveyed by the secondary transfer device 5 and the transfer belt 11 rotating in the A1 direction, and is fed into the fixing device 6. In the fixing device 6, the toner image thus carried, that is, the combined color image is fixed onto the transfer sheet S by the action of heat and pressure while the transfer sheet S is passing through the fixing portion between the fixing belt 64 and the pressing roller 63.

In single-side printing in which an image is formed on one side alone, and after images are formed on both sides in duplex printing in which images are formed on both sides, the transfer sheet S that passes through the fixing device 6 and on which the combined color image is fixed is conveyed to the discharge path 83 by a switching operation of the bifurcating claw 85. By contrast, after an image is formed on one side in the duplex printing, the transfer sheet S is conveyed to the re-feed path 84.

The transfer sheet S conveyed to the re-feed path 84 is reversed by the duplex unit 51, and passes through the pair of registration rollers 4, the secondary transfer portion 57, and the fixing device 6 again. After an image is formed on the other side of the transfer sheet S, the transfer sheet S is returned to the discharge path 83.

The transfer sheet S conveyed to the discharge path 83 passes through the ejecting rollers 7, and is discharged to the outside of the main body 99. At the same time, the transfer sheet S enters the post-processing apparatus 40, and is subjected to predetermined post-processing, that is, to sheet processing by a shift operation or a stapling operation, which will be described later. Alternatively, without performing the sheet processing, the transfer sheet S is stacked on the discharge tray 17 as an image output material.

Transfer residual toner remaining on the photosensitive elements 20Y, 20M, 20C, and 20BK after the transfer is removed by the cleaning devices 71Y, 71M, 71C, and 71BK, respectively. The photosensitive elements 20Y, 20M, 20C, and 20BK are then neutralized by the neutralization devices to prepare for subsequent charging by the charging units 79Y, 79M, 79C, and 79BK.

The surface of the transfer belt 11 that has finished the secondary transfer and passed through the secondary transfer portion 57 is cleaned by the cleaning member included in the cleaning device 13 to prepare for subsequent transfer.

As described above, the post-processing apparatus 40 can perform the shift operation and the stapling operation. The shift operation and the stapling operation are performed in a shift mode and a stapling mode, respectively. These modes are selected and set through the operation panel. Thus, the post-processing apparatus 40 has the shift mode and the stapling mode as a paper passing mode, and also has a through mode as a paper passing mode in which neither the shift operation nor the stapling operation is performed.

The operations of the post-processing apparatus 40 in the shift mode and the stapling mode will now be described. The operation in the through mode will be described additionally in the description of the operation in the shift mode.

Shift Mode

In the present mode, the transfer sheets S are sorted by shifting the stacking position of the transfer sheets S on the discharge tray 17 in the width direction of the transfer sheet S for each predetermined number of sheets. To shift the stacking position of the transfer sheet S on the discharge tray 17 in the width direction of the transfer sheet S, the post-processing apparatus 40 shifts the discharge position of the transfer sheet S to the discharge tray 17 in the width direction.

Therefore, the control unit 96 functioning as the post-processing control unit drives the shift motor for each predetermined number of sheets, causes the pair of shift discharging rollers 43 to move in the width direction of the transfer sheet S, and discharges the transfer sheet S to the discharge tray 17. At this time, the control unit 96 functioning as the post-processing control unit drives the roller displacement stepping motor to displace the lever 85 downward, thereby causing the driven roller 56 coming into contact with the discharging roller 55. In addition, the control unit 96 drives the discharging motor 59 to drive the discharging roller 55. As a result, the transfer sheet S conveyed by the pair of shift discharging rollers 43 is nipped between the discharging roller 55 and the driven roller 56. The transfer sheet S is then discharged and stacked onto the discharge tray 17 by the discharging roller 55 that drives and the driven roller 56 that is dragged to rotate.

By discharging the transfer sheet S onto the discharge tray 17 in this manner, if the shift motor drives a plurality of times, for example, the stacking position of the transfer sheet S on the discharge tray 17 shifts alternately in the width direction. In the shift mode, the transfer sheets S are sorted in this manner.

The number of times to perform the shift is input through the operation panel.

To prevent discharge trouble from occurring in which the transfer sheet S being discharged onto the discharge tray 17 by the discharging roller 55 abuts on the transfer sheet S already stacked on the discharge tray 17 because the stacking amount of the transfer sheets S on the discharge tray 17 increases, the control unit 96 functioning as the post-processing control unit performs the following control.

Specifically, in synchronization with an operational timing at which the trailing edge of each transfer sheet S passes by the entrance sensor 86, the control unit 96 functioning as the post-processing control unit functions as the upward and downward driving control unit. The control unit 96 drives the tray DC motor 89*a*, thereby causing the tip of the movable tray portion 17*b* to descend by a predetermined amount.

At this time, the control unit 96 functioning as the post-processing control unit turns OFF the solenoid 91 for each predetermined number of sheets, that is, for each five sheets in the present embodiment in synchronization with an operational timing at which the transfer sheet S is conveyed, more specifically, an operational timing at which the trailing edge of the transfer sheet S passes by the bundle discharging sensor 88, thereby causing the sheet holder 90 to perform the sheet holding operation. Furthermore, in response to a signal from the tray paper surface detection sensor 92, the control unit 96 functions as the upward and downward driving control unit. The control unit 96 drives the tray DC motor 89*a*, thereby placing the tip of the movable tray portion 17*b* in a fixed position at which no discharge trouble occurs.

The fixed position will now be described.

Figure 14A:
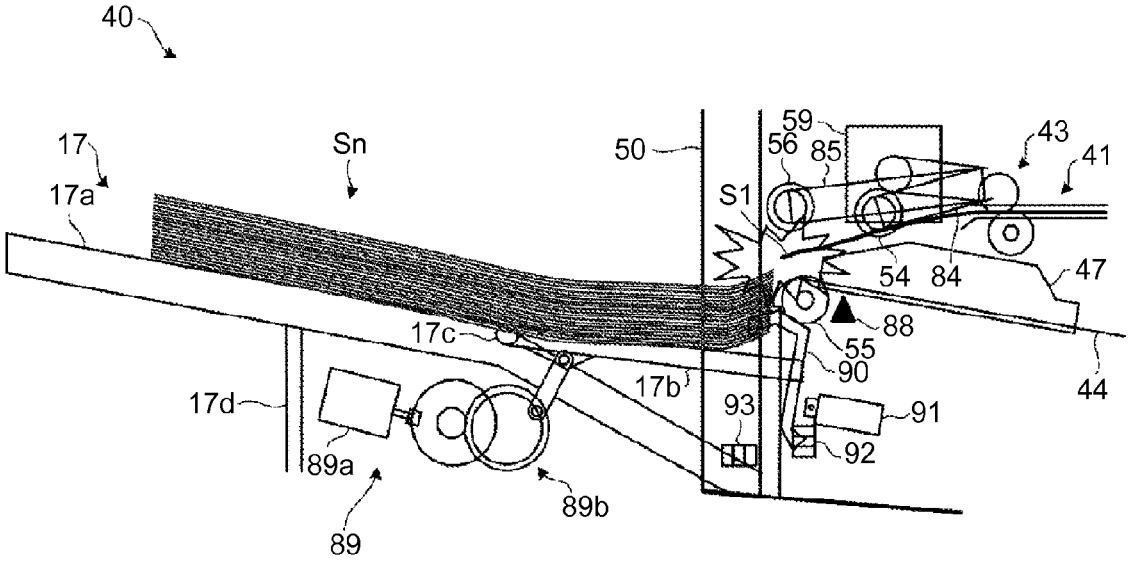
FIGS. 14A and 14B are schematics for explaining a problem possibly occurring in the post-processing apparatus.

As described above, the transfer sheets S are required to be discharged and stacked on the discharge tray 17 by the discharging roller 55 properly. However, if the stacking amount of the transfer sheets S on the discharge tray 17 increases, and the stacking height thereof increases, transfer sheets Sn on the discharge tray 17 may prevent discharge of the transfer sheet S performed by the discharging roller 55 as illustrated in FIG. 14A.

In other words, if the stacking amount of the transfer sheets Sn on the discharge tray 17 increases, a transfer sheet S to be discharged onto the discharge tray 17 by the discharging roller 55 may possibly abut on the transfer sheets Sn already stacked on the discharge tray 17, thereby causing discharge trouble. The transfer sheets Sn in FIG. 14A illustrate a plurality of transfer sheets S stacked on the discharge tray 17.

Figure 14B:
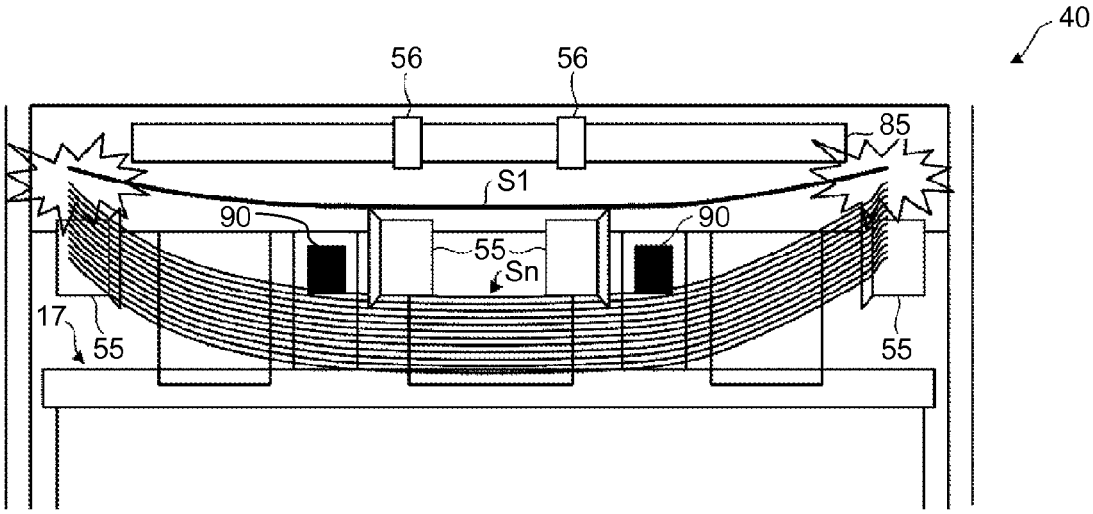

As described above, to prevent the discharge trouble from occurring, the discharge tray 17 is caused to descend to the fixed position. The stacking height will now be described in greater detail. The transfer sheet S may curl because of heat and pressure applied thereto while an image is being formed. In particular, if so-called side curl occurs in which both side edges of the transfer sheet S curl upward as illustrated in FIG. 14B, the stacking height increases compared with the case where the transfer sheet S is in a planer shape. Therefore, if the side curl occurs, the discharge trouble is likely to occur.

To prevent the discharge trouble from occurring even if the stacking height increases because of the side curl, an increment in the stacking height due to the side curl needs only to be added to the descent amount of the discharge tray 17 when the discharge tray 17 is caused to descend depending on the stacking height.

Therefore, the tray paper surface detection sensor 92 is arranged at a position obtained by adding the increment in the stacking height due to the side curl. As a result, the fixed position is set to a position at which the uppermost transfer sheet S among the transfer sheets Sn on the discharge tray 17 occupies the first position. At the first position, even if side curl occurs in the transfer sheets Sn on the discharge tray 17, the uppermost transfer sheet S does not reach the height of the discharge position of the discharging roller 55, that is, the uppermost transfer sheet S does not reach the height of the staple tray 44, whereby the transfer sheet S being discharged by the discharging roller 55 does not abut on the uppermost transfer sheet S.

Therefore, the fixed position is set to a position obtained by causing the movable tray portion 17*b* to descend from a predetermined position, which will be described below, in the height direction of the discharge tray 17, more specifically, of the movable tray portion 17*b* by a height necessary and sufficient for preventing the transfer sheet S being discharged by the discharging roller 55 from abutting on the uppermost transfer sheet S.

The predetermined position is a necessary and sufficient position to be occupied by the discharge tray 17, more specifically, by the movable tray portion 17*b* in the height direction for preventing the transfer sheet S being discharged by the discharging roller 55 from abutting on the uppermost transfer sheet S if no deformation, such as side curl, occurs in the transfer sheet S on the discharge tray 17, and the uppermost transfer sheet S is in a planer shape.

More specifically, the fixed position is a position achieved by causing the movable tray portion 17*b* to descend from the predetermined position of the discharge tray 17, more specifically, of the movable tray portion 17*b* by the height obtained by adding an upward deformation amount of the uppermost transfer sheet S due to the side curl. In other words, the fixed position is lower than the predetermined position by the height. The deformation amount is an upward deformation amount of the uppermost transfer sheet S compared with the case where the uppermost transfer sheet S is in the planer shape.

If the first height, that is, the height from the discharge position of the discharging roller 55 to the uppermost transfer sheet S is set too great, behavior until the whole body of the transfer sheet S discharged by the discharging roller 55 is placed onto the uppermost transfer sheet S is made unstable. As a result, the stacking state of the transfer sheets Sn on the discharge tray 17 may possibly be disturbed. Furthermore, if the stacking state is disturbed significantly, sorting trouble may possibly occur.

To address this, the fixed position is set such that the height, which is the first height, from the position of the upper surface of the uppermost transfer sheet S on the discharge tray 17 to the nip portion formed by the discharging roller 55 and the driven roller 56 coming into contact with each other is a constant height necessary and sufficient for preventing such abutment from occurring.

By setting the fixed position in this manner, discharge trouble on the discharge tray 17 is prevented and suppressed. Furthermore, the contact angle between the transfer sheet S being discharged from the nip portion and the position of the upper surface or the exposed upper surface of the discharge tray 17 is made constant. As a result, the transfer sheets S are aligned on the discharge tray 17 stably and properly. In addition, on condition that such abutment is prevented from occurring, as many transfer sheets S as possible are stacked on the discharge tray 17 orderly in a sorted manner.

The solenoid 91 may be turned OFF not for each five discharged sheets, but for each another number of sheets, for each one sheet, for example. Furthermore, in the through mode in which the transfer sheets S are stacked on the discharge tray 17 in the post-processing apparatus 40 without performing the shift operation or the stapling operation, the operations described above are performed under control of the control unit 96 functioning as the post-processing control unit while the shift motor is being kept to stop driving.

Stapling Mode

In the present mode, a plurality of transfer sheets S are stacked in a bound manner on the discharge tray 17. To stack the transfer sheets S in a bound manner on the discharge tray 17, the post-processing apparatus 40 performs a binding operation on the transfer sheets S, and discharges the whole bound bundle of the transfer sheets S onto the discharge tray 17.

An outline of a stapling operation performed for the processing described above will be explained.

Based on an operational timing at which the entrance sensor 86 detects the trailing edge of the transfer sheet S, and based on an operational timing at which the trailing edge of the transfer sheet S conveyed through the discharge conveying path 41 passes through the pair of shift discharging rollers 43, the control unit 96 functioning as the post-processing control unit drives the roller displacement stepping motor, and causes the lever 84 to swing. Thus, the tapping roller 54 is displaced downward, thereby pressing the transfer sheet S against the staple tray 44. In addition, the control unit 96 drives the discharging motor 59, and causes the transfer sheet S to switchback using the tapping roller 54, thereby performing alignment in the conveying direction of the transfer sheet S.

Furthermore, as described above, the control unit 96 functioning as the post-processing control unit drives the jogger fence 47, thereby performing alignment in the width direction of the transfer sheet S.

These aligning operations are performed repeatedly until all the transfer sheets S to be bound in one binding operation are stacked and aligned on the staple tray 44. After the alignment is completed, the control unit 96 functioning as the post-processing control unit drives the stapler 49, thereby binding the bundle of the transfer sheets S on the staple tray 44 as described above. At this time, the control unit 96 functioning as the post-processing control unit turns OFF the solenoid 91, thereby causing the sheet holder 90 to perform the sheet holding operation.

After the binding, the control unit 96 functioning as the post-processing control unit drives the roller displacement stepping motor, and causes the lever 85 to swing. Thus, the driven roller 56 is displaced downward, whereby the bundle of the transfer sheets S thus bound is nipped between the driving roller 55 and the driven roller 56. In addition, the control unit 96 drives the discharging motor 59, and causes the driving roller 55 to discharge the bundle of the transfer sheets S onto the discharge tray 17.

At an operational timing after driving the discharging motor 59 by a constant step and while discharging the bundle of the transfer sheets S onto the discharge tray 17, the control unit 96 functioning as the post-processing control unit turns ON the solenoid 91, and cancels the sheet holding operation performed by the sheet holder 90. The control unit 96 then functions as the upward and downward driving control unit, and drives the tray DC motor 89*a*, thereby causing the tip of the movable tray portion 17*b* to descend by a predetermined amount.

Subsequently, based on an operational timing at which the trailing edge of the bundle of the transfer sheets S passes by the bundle discharging sensor 88, the control unit 96 functioning as the post-processing control unit functions as the upward and downward driving control unit again, and drives the tray DC motor 89*a*, thereby causing the tip of the movable tray portion 17*b* to ascend. In addition, the control unit 96 stops driving of the discharging motor 59, and prepares for receiving of a subsequent bundle of transfer sheets S on which binding is performed to the discharge tray 17. Simultaneously with stopping driving of the discharging motor 59, the control unit 96 functioning as the post-processing control unit turns OFF the solenoid 91, thereby causing the sheet holder 90 to perform the sheet holding operation.

The schematic operations in the stapling mode have been described. However, if operations in the stapling mode are performed only by the operations described above, the following problem may possibly occur.

As described in the explanation of the shift mode with reference to FIGS. 14A and 14B, the transfer sheets S are required to be discharged and stacked on the discharge tray 17 by the discharging roller 55 properly. However, if the stacking amount of the transfer sheets S on the discharge tray 17 increases, and the stacking height thereof increases, the transfer sheets Sn on the discharge tray 17 may prevent discharge of the transfer sheet S performed by the discharging roller 55. As a result, discharge trouble may occur.

Also in the stapling mode, side curl may possibly occur. Therefore, to prevent such discharge trouble from occurring, the discharge tray 17 may be caused to descend depending on the stacking height to which the height of the side curl is added in the same manner as in the shift mode.

In the stapling mode, however, if the bundle of the transfer sheets S on which the binding is performed is stacked on the discharge tray 17, the part thus bound is made bulky in the transfer sheets Sn because of the thickness of the staple, curl caused by the binding, and other factors. As a result, the stacking height increases compared with the case where the transfer sheet S is in a planer shape or the case where side curl simply occurs. Because the portion to be bound in the transfer sheet S is likely to be the same portion, the portion may be significantly bulky in the transfer sheets Sn.

As a result, in the stapling mode, it is more likely that the uppermost transfer sheet S among the transfer sheets Sn on the discharge tray 17 reaches the height of the discharge position of the discharging roller 55, and that the leading edge of the transfer sheet S being discharged by the discharging roller 55 abuts on the trailing edge of the transfer sheets Sn including the uppermost transfer sheet S.

The post-processing apparatus 40 performs binding on the transfer sheets S with a part of the leading edge of each transfer sheet S positioned on the discharge tray 17. Therefore, if such abutment occurs and prevents the state described above from being formed, the binding fails to be performed. In addition, a defect, such as a jam of the transfer sheet S, may possibly occur. Furthermore, even if such abutment occurs, the transfer sheet S may climb over the transfer sheets Sn, thereby forming the state described above. In this case, however, because the stacking state is frequently disturbed, defects such as poor binding and misalignment in the transfer sheets S may possibly occur.

To prevent such discharge trouble from occurring even if the stacking height increases because of the binding, it may be only necessary to add an increment in the stacking height due to the binding to the descent amount of the discharge tray 17 in addition to the increment due to the side curl when the discharge tray 17 is caused to descend depending on the stacking height.

However, an increase in the stacking height due to the binding occurs randomly depending on the number of transfer sheets constituting the bundle of the transfer sheets S on which the binding is performed, that is, on the number of the transfer sheets S in one copy to be bound, for example.

To address this, the discharge tray 17 may be caused to descend by adding the maximum increment in the stacking height due to the binding to the descent amount of the discharge tray 17. If the discharge tray 17 is caused to descend by a descent amount simply set so large, and the transfer sheet S is discharged thereto, the descent amount thus set leads to excessive descent if the increment in the stacking height is actually small, for example. As a result, the stacking state of the transfer sheets S on the discharge tray 17 may possibly be disturbed in the same manner as in the explanation of the shift mode.

Because the post-processing apparatus 40 performs binding on the transfer sheets S with a part of the leading edge of each transfer sheet S positioned on the discharge tray 17, defects such as poor binding and misalignment in the transfer sheets S may possibly occur in this case as well.

As described above, because the post-processing apparatus 40 performs the binding on the transfer sheets S with a part of the leading edge of each transfer sheet S positioned on the discharge tray 17, the state of the transfer sheets S on the discharge tray 17 may influence the quality of the binding. Therefore, when the transfer sheet S is discharged, simply causing the discharge tray 17 to descend may possibly degrade the binding performance and the alignment performance for the transfer sheets S.

To address this, in the stapling mode in which the stapler 49 performs binding, the post-processing apparatus 40 performs an operation for causing the discharge tray 17 to descend and other operations only when a first sheet of the transfer sheets S to be bound, that is, a first transfer sheet S of each copy, which is a unit to be bound, is discharged to the discharge tray 17 in addition to the schematic operations described above.

Figure 7:
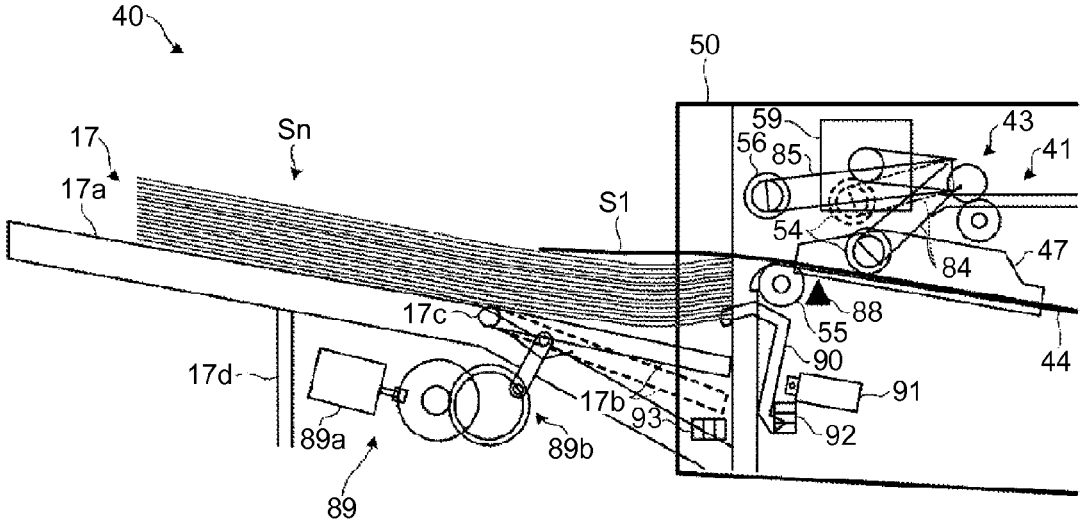
FIG. 7 is a schematic front sectional view illustrating a fourth state of the part of the post-processing apparatus illustrated in FIG. 1.
Figure 8:
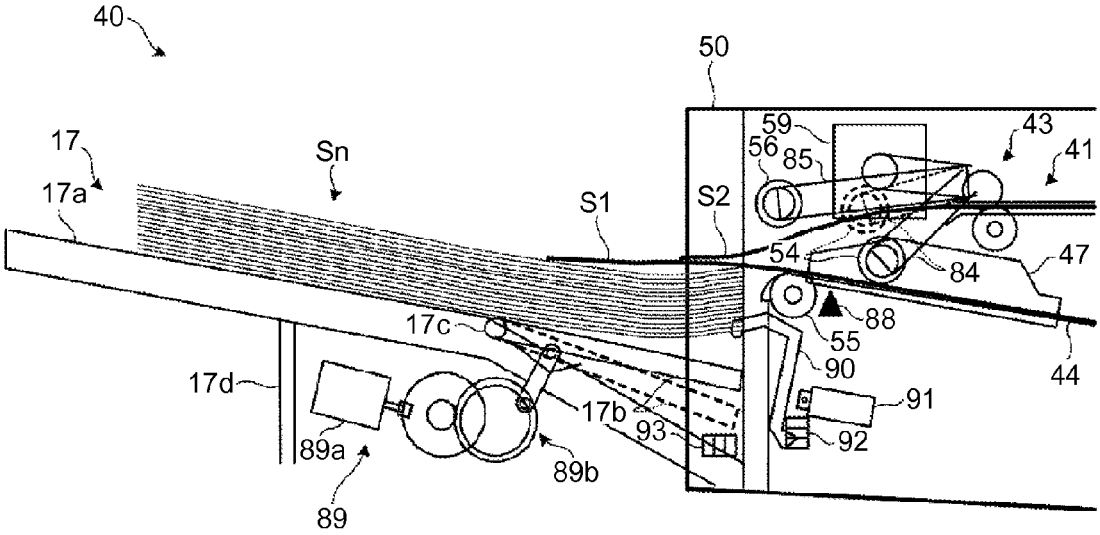
FIG. 8 is a schematic front sectional view illustrating a fifth state of the part of the post-processing apparatus illustrated in FIG. 1.

This operation will be described with reference to FIG. 4 to FIG. 9, and FIG. 10 as appropriate. In FIG. 4 to FIG. 8, a reference numeral S1 denotes the first transfer sheet S of each copy. In FIG. 8, a reference numeral S2 denotes a second transfer sheet S of each copy.

Figure 4:
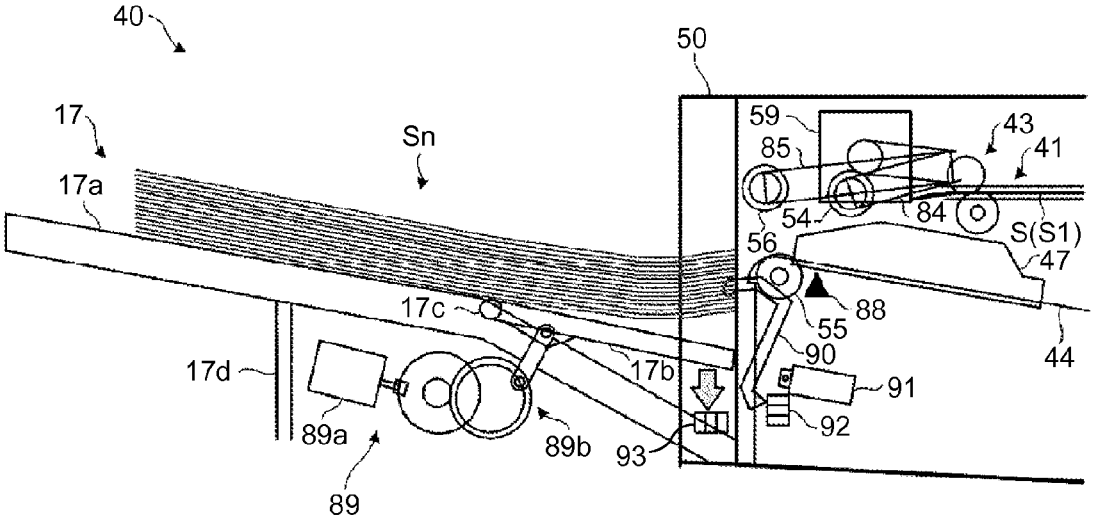
FIG. 4 is a schematic front sectional view illustrating a first state of a part of the post-processing apparatus illustrated in FIG. 1.
Figure 10:
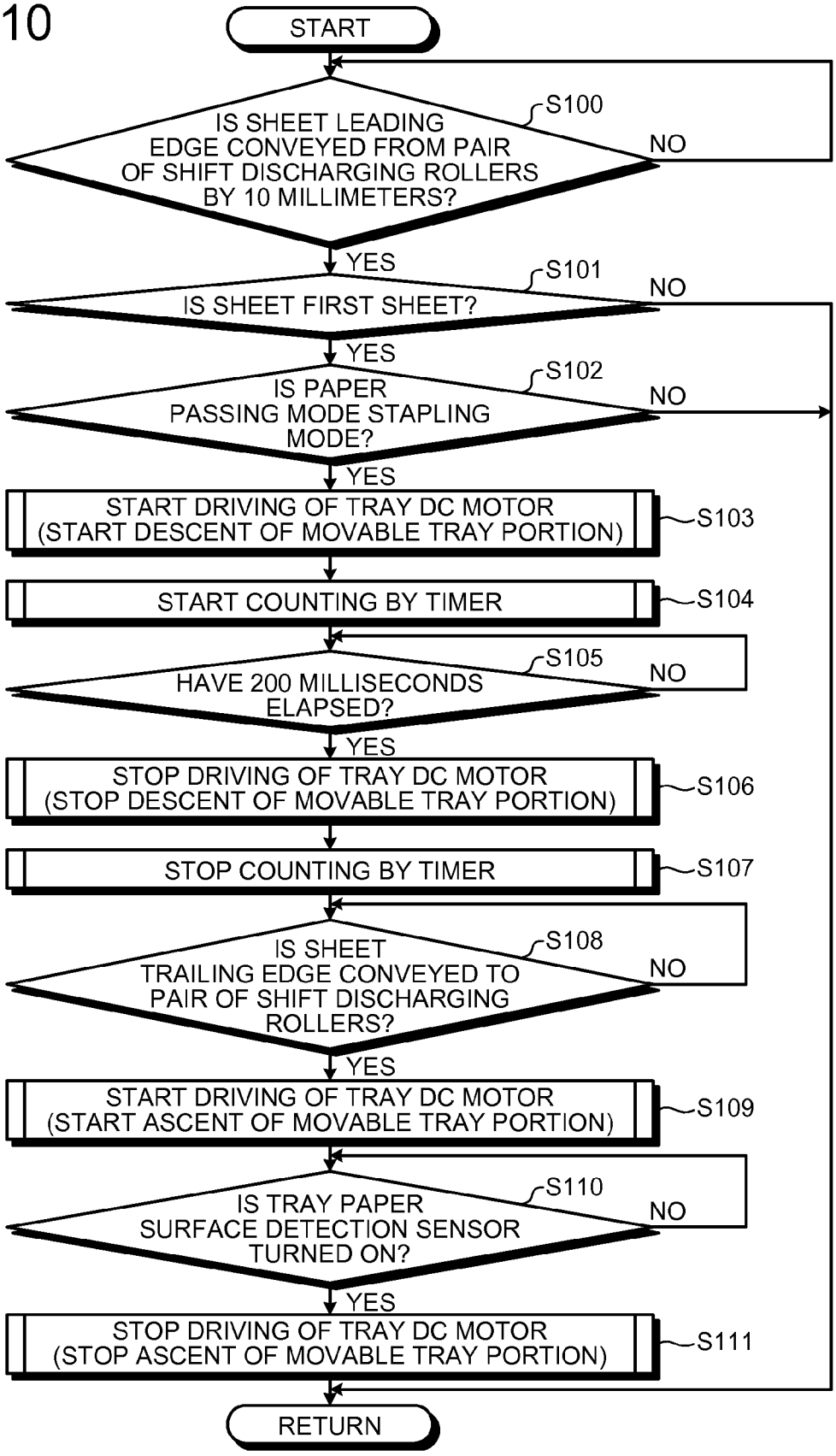
FIG. 10 is a flowchart illustrating a part of an exemplary operation performed by the post-processing apparatus illustrated in FIG. 1.

As illustrated in FIG. 4, the control unit 96 functioning as the post-processing control unit is in a standby mode until the transfer sheet S is conveyed through the discharge conveying path 41, the leading edge thereof reaches the pair of shift discharging rollers 43, and the leading edge is further conveyed by 10 millimeters therefrom based on a detection timing of the leading edge of the transfer sheet S by the entrance sensor 86 (Step S100 in FIG. 10). If the leading edge of the transfer sheet S is conveyed from the pair of shift discharging rollers 43 by 10 millimeters, the control unit 96 determines whether the transfer sheet S is the first transfer sheet S1 on which binding is to be performed (Step S101 in FIG. 10).

If the transfer sheet S is the first transfer sheet S1, the control unit 96 functioning as the post-processing control unit determines whether the paper passing mode is the stapling mode (Step S102 in FIG. 10). If the paper passing mode is the stapling mode, the control unit 96 functions as the upward and downward driving control unit, and drives the tray DC motor 89*a*, thereby starting descent of the tip of the movable tray portion 17*b* (Step S103 in FIG. 10).

If the transfer sheet S is not the first transfer sheet S1 at Step S101, or if the paper passing mode is not the stapling mode at Step S102, the control unit 96 terminates the processing illustrated in FIG. 4, and is in the standby mode until a subsequent transfer sheet S is detected by the entrance sensor 86.

If descent of the discharge tray 17 is started at Step S103, the control unit 96 functioning as the post-processing control unit starts counting by a timer embedded for measuring time regardless of whether the tray paper surface detection sensor 92 detects the sheet holder 90 (Step S104 in FIG. 10). The control unit 96 waits in the standby mode until 200 milliseconds set as downtime elapse (Step S105 in FIG. 10). If the downtime elapses, the control unit 96 functions as the upward and downward driving control unit, and stops driving of the tray DC motor 89*a*, thereby stopping the descent of the tip of the movable tray portion 17*b* as illustrated in FIG. 5 (Step S106 in FIG. 10).

At this time, the position occupied by the tip of the movable tray 17*b* is a position lower than the fixed position by 20 millimeters. Therefore, a second position, which is a position of the upper surface of the trailing edge of the uppermost transfer sheet S on the discharge tray 17 at this time, is lower than the first position by 20 millimeters. A second height, which is a height from the position of the upper surface of the transfer sheet S to the nip portion formed by the discharging roller 55 and the driven roller 56 coming into contact with each other, is higher than the first height by 20 millimeters.

If the control unit 96 functions as the upward and downward driving control unit stops driving of the tray DC motor 89*a*, the control unit 96 functioning as the post-processing control unit stops counting by the timer (Step S107 in FIG. 10).

Figure 5:
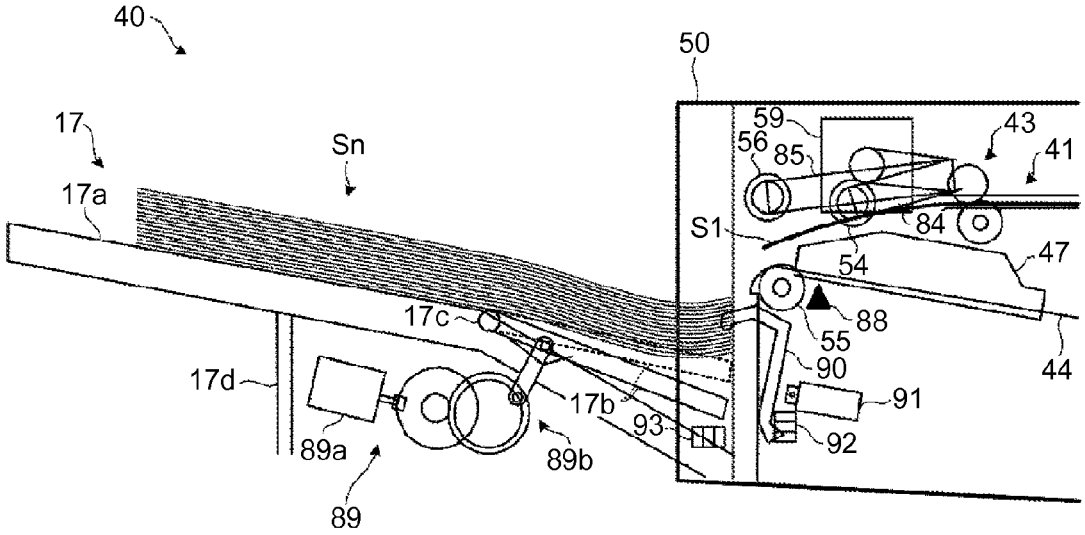
FIG. 5 is a schematic front sectional view illustrating a second state of the part of the post-processing apparatus illustrated in FIG. 1.

As illustrated in FIG. 5, until the downtime elapses, the transfer sheet S1 continues to be conveyed by the pair of shift discharging rollers 43, and the leading edge thereof enters between the discharging roller 55 and the driven roller 56 separated from the discharging roller 55.

Time of 200 milliseconds serving as the downtime is a driving time of the tray DC motor 89*a* calculated based on actual measurement by adding the increment in the stacking height due to binding in addition to the increment due to side curl so as to prevent the transfer sheet S1 from abutting on the transfer sheets Sn. In other words, the time is time for causing the movable tray portion 17*b* to descend from the fixed position described above by a height of 20 millimeters corresponding to the height obtained by adding an upward deformation amount of the uppermost transfer sheet S on the discharge tray 17 due to side curl and binding.

In other words, the downtime is time required for causing the discharge tray 17, more specifically, the movable tray portion 17*b* to descend from the fixed position by 20 millimeters, which is a height necessary and sufficient for preventing the transfer sheet S being discharged by the discharging roller 55 from abutting on the uppermost transfer sheet S.

Therefore, the position of the discharge tray 17, more specifically, the position of the movable tray portion 17*b* when the uppermost transfer sheet S is at the second position is a position to which the movable tray portion 17*b* is caused to descend from the fixed position in a manner corresponding to the height obtained by adding the upward deformation amount of the uppermost transfer sheet S due to side curl and binding. The upward deformation amount is an upward deformation amount of the uppermost transfer sheet S compared with the case where the uppermost transfer sheet S is in the planer shape.

Figure 6:
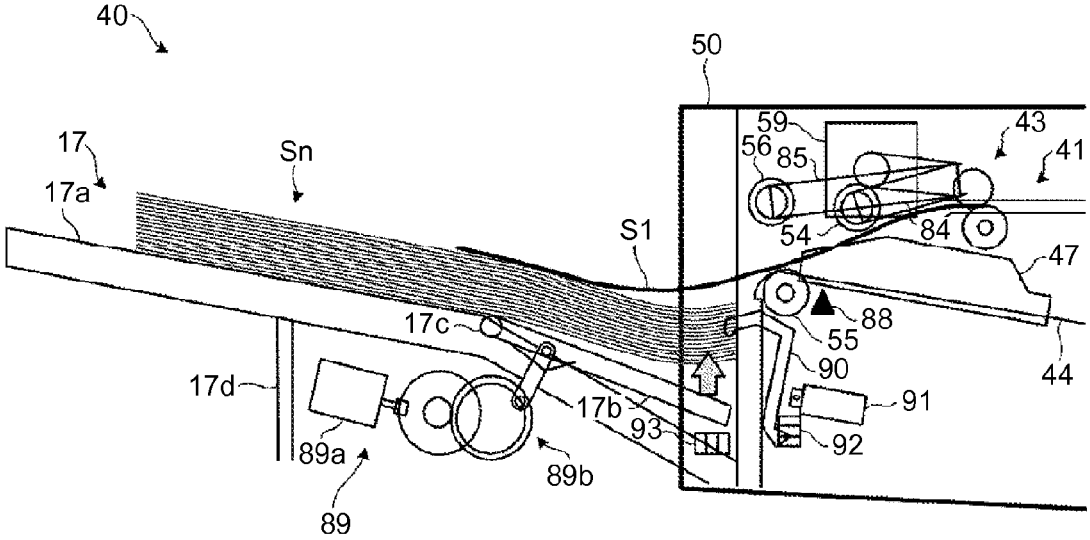
FIG. 6 is a schematic front sectional view illustrating a third state of the part of the post-processing apparatus illustrated in FIG. 1.

As a result, as illustrated in FIG. 6, the leading edge of the transfer sheet S1 proceeds to the discharge tray 17 without abutting on the trailing edge of the transfer sheets Sn. Thus, it is possible to prevent disturbance in the stacking state caused by the abutment from occurring.

The transfer sheet S1 whose leading edge proceeds to the discharge tray 17 is further conveyed by the pair of shift discharging rollers 43. During this time, the control unit 96 functioning as the post-processing control unit waits until the trailing edge of the transfer sheet S1 is conveyed by the pair of shift discharging rollers 43 based on a detection timing of the trailing edge of the transfer sheet S1 by the entrance sensor 86 (Step S108 in FIG. 10).

If it is determined that the trailing edge of the transfer sheet S1 reaches the pair of shift discharging rollers 43, the control unit 96 functioning as the post-processing control unit functions as the upward and downward driving control unit. The control unit 96 drives the tray DC motor 89*a*, thereby starting ascent of the tip of the movable tray portion 17*b* as illustrated in FIG. 7 (Step S109 in FIG. 10). At the same time, the control unit 96 performs switchback and alignment of the transfer sheet S1 in the manner described above.

The ascent of the discharge tray 17 is continued until the tray paper surface detection sensor 92 detects the sheet holder 90 (Step S110 in FIG. 10). If the tray paper surface detection sensor 92 detects the sheet holder 90, the control unit 96 functioning as the post-processing control unit stops the ascent of the discharge tray 17 (Step S111 in FIG. 10).

Subsequently, as illustrated in FIG. 8, the transfer paper S2 is conveyed. At this time, the position of the uppermost transfer sheet S among the transfer sheets Sn occupies the first position higher than the second position. Because a part of the leading edge of the transfer sheet S1 is positioned on the discharge tray 17, when the leading edge of the transfer sheet S2 is discharged onto the discharge tray 17, the leading edge thereof is conveyed sequentially along a portion placed on the staple tray 44 in the transfer sheet S1, that is, along the upper surface of a portion positioned on the discharging roller 55 in the transfer sheet S1. As a result, the leading edge reaches the discharge tray 17 without abutting on the trailing edge of the transfer sheets Sn.

Therefore, the transfer sheet S2 is discharged in a manner stacked on the transfer sheet S1 without causing any discharge trouble. Subsequently, as described above, the transfer sheet S2 is caused to switchback and to be aligned together with the transfer sheet S1 by the control unit 96 functioning as the post-processing control unit. Furthermore, because the height of the transfer sheets Sn is returned to the fixed position, the stacking state of the transfer sheet S2 on the discharge tray 17 is made excellent. If the binding is performed on three or more transfer sheets S, another transfer sheet S is conveyed, discharged, and caused to switchback and to be aligned similarly to the transfer sheet S2.

Figure 9:
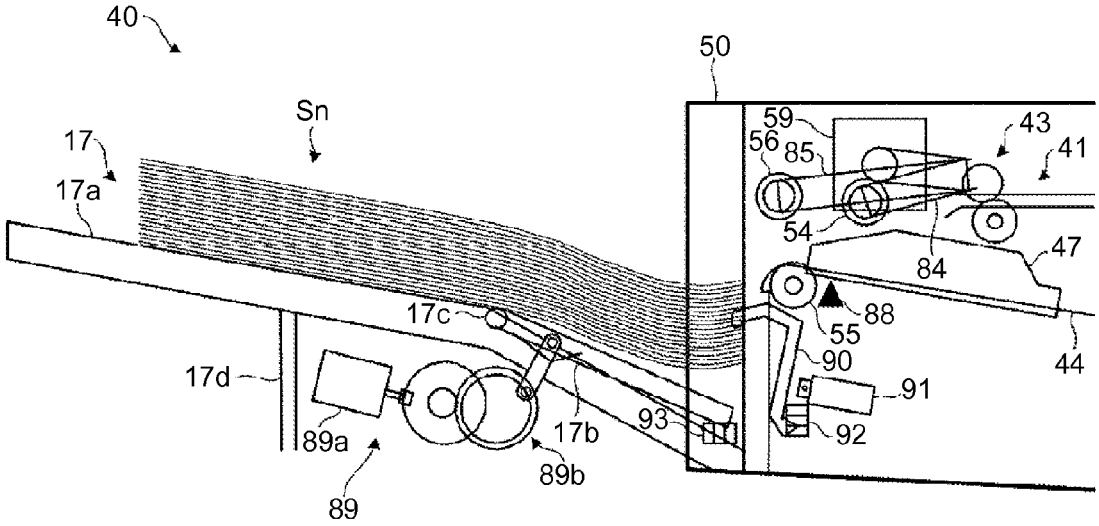
FIG. 9 is a schematic front sectional view illustrating a sixth state of the part of the post-processing apparatus illustrated in FIG. 1.

After all the transfer sheets S on which binding is to be performed are aligned, the control unit 96 functioning as the post-processing control unit drives the stapler 49, thereby performing the binding in the manner described above. Subsequently, by driving the discharging roller 55 and the like, the bundle of the transfer sheets S on which the binding is performed is discharged onto the discharge tray 17, and a state illustrated in FIG. 9 is formed. As illustrated in FIG. 9, the whole bundle of the transfer sheets S is discharged onto the discharge tray 17.

When the bundle of the transfer sheets S on which the binding is performed is discharged onto the discharge tray 17, the leading edge of the lowermost transfer sheet S among the transfer sheets S constituting the bundle, that is, the leading edge of the transfer sheet S1 is already positioned on the discharge tray 17. As a result, the bundle of the transfer sheets S can be discharged properly without abutting on the trailing edge of the transfer sheets Sn.

As described above, in the stapling operation, the discharge tray 17 is caused to descend before the leading edge of the transfer sheet S1 to be bound reaches a position on the discharge tray 17. After the leading edge is positioned on the discharge tray 17, the discharge tray 17 is caused to ascend before the leading edge of the transfer sheet S2 to be bound reaches to a position on the discharge tray 17. As a result, a part of the leading edge of the transfer sheet S1 is positioned on the discharge tray 17 reliably. In addition, a part of the leading edge of the transfer sheet S2 and those of transfer sheets subsequent thereto are positioned on the discharge tray 17 reliably. Therefore, binding is performed reliably with a part of the leading edge of each transfer sheet S is positioned on the discharge tray 17. Accordingly, it is possible to prevent and suppress occurrence of a jam in the transfer sheets S because the state described above fails to be formed.

When the transfer sheet S1 is discharged onto the discharge tray 17, the movable tray portion 17*b* occupies a position lower than the fixed position, and the second height, which is the height from the nip portion formed by the discharging roller 55 and the driven roller 56 coming into contact with each other to the position of the upper surface of the uppermost transfer sheet S on the discharge tray 17 is higher than the first height, which is the height employed in normal discharge. As a result, the position of the transfer sheet S1 is likely to be misaligned on the discharge tray 17.

The transfer sheet S1 is affected by switchback and alignment performed on the transfer sheet S2 and transfer sheets S subsequent thereto in addition to its own switchback and alignment. As a result, even if positional deviation occurs, every time the post-processing apparatus 40 performs the switchback operation and the alignment operation, the positional deviation can be corrected. Therefore, it is also possible to prevent and suppress occurrence of poor binding and misalignment in the transfer sheets S in the post-processing apparatus 40.

In the operations of the stapling mode described with reference to FIG. 10, the operations for stopping upward and downward movement of the movable tray portion 17*b* by using the discharge tray fullness sensor 93 described above is omitted. Alternatively, the operations may be performed as illustrated in FIG. 11.

In the operations illustrated in FIG. 11, a different section from that in the explanation with reference to FIG. 10 will now be explained. The different section is a section between Step S104 to Step S106.

Figure 11:
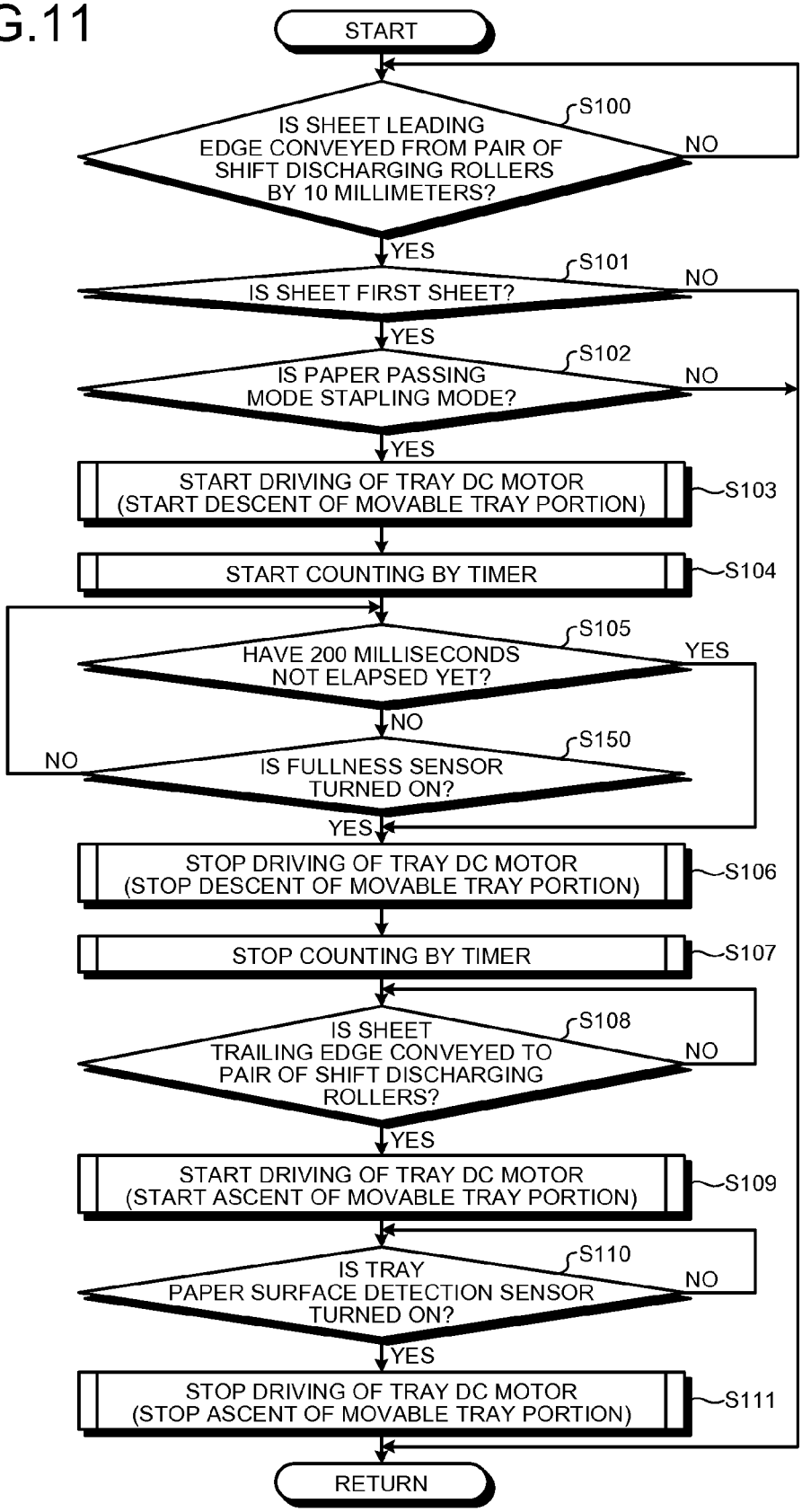
FIG. 11 is a flowchart illustrating a part of another exemplary operation performed by the post-processing apparatus illustrated in FIG. 1.

Specifically, after the counting by the timer is started at Step S104, the control unit 96 functioning as the post-processing control unit waits until 200 milliseconds set as the downtime elapse (Step S105 in FIG. 11). At the same time, the control unit 96 determines whether the discharge tray fullness sensor 93 detects that transfer sheets S exceeding the predetermined permissible amount are stacked on the discharge tray 17, that is, whether the discharge tray 17 is in the fullness state (Step S150 in FIG. 11).

If it is determined that the discharge tray 17 is in the fullness state at Step S150, the control unit 96 functioning as the post-processing control unit functions as the upward and downward driving control unit even if 200 milliseconds have not elapsed yet at Step S105. The control unit 96 stops driving of the tray DC motor 89*a*, thereby stopping the descent of the tip of the movable tray portion 17*b* (Step S106 in FIG. 11).

Furthermore, if 200 milliseconds has elapsed at step S105, the control unit 96 functioning as the post-processing control unit functions as the upward and downward driving control unit, and performs the operation at Step S106 even if it is not determined that the discharge tray 17 is in the fullness state at Step S150.

In the stapling mode described above, the downtime is fixed to 200 milliseconds. Alternatively, the downtime may be time for causing the movable tray portion 17*b* to descend from the fixed position described above by a height depending on at least one of the binding position of the transfer sheets S by the stapler 49, the type of the transfer sheet S to be bound by the stapler 49, and the number of transfer sheets S to be bound by the stapler 49.

Depending on the position, the height, and the time, the upward deformation amount of the uppermost transfer sheet S on the discharge tray 17 is changed. By adjusting the downtime depending on these factors, it is possible to prevent discharge trouble, that is, discharge trouble caused by abutment of the transfer sheets S being discharged onto the discharge tray 17 by the discharging roller 55 on the transfer sheets S already stacked on the discharge tray 17 from occurring.

In this case as well, it is preferable that the downtime be time obtained by adding the condition of the upper deformation amount of the uppermost transfer sheet S on the discharge tray 17 due to the binding as described above.

Figure 12A:
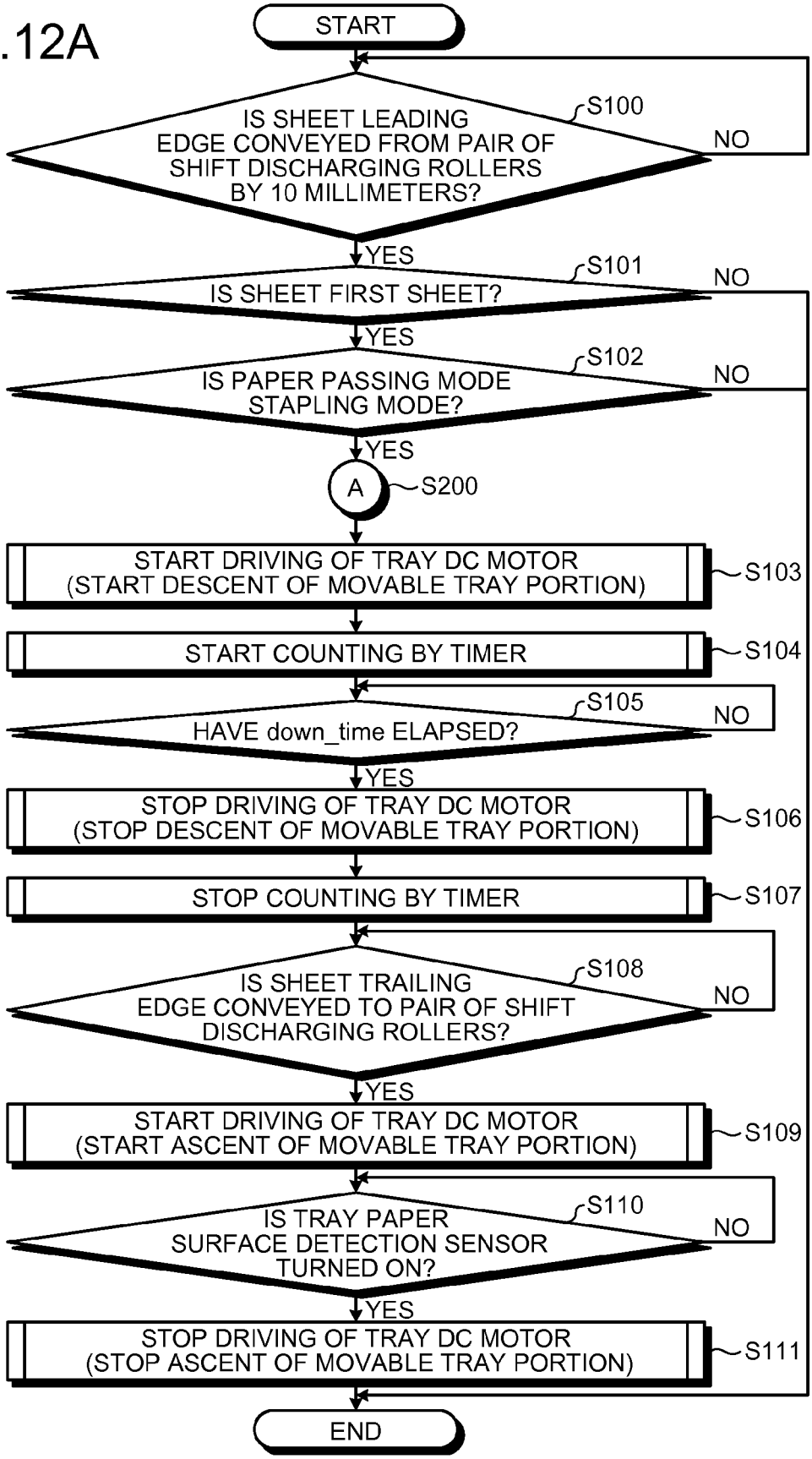
FIGS. 12A and 12B are flowcharts illustrating a part of still another exemplary operation performed by the post-processing apparatus illustrated in FIG. 1.
Figure 12B:
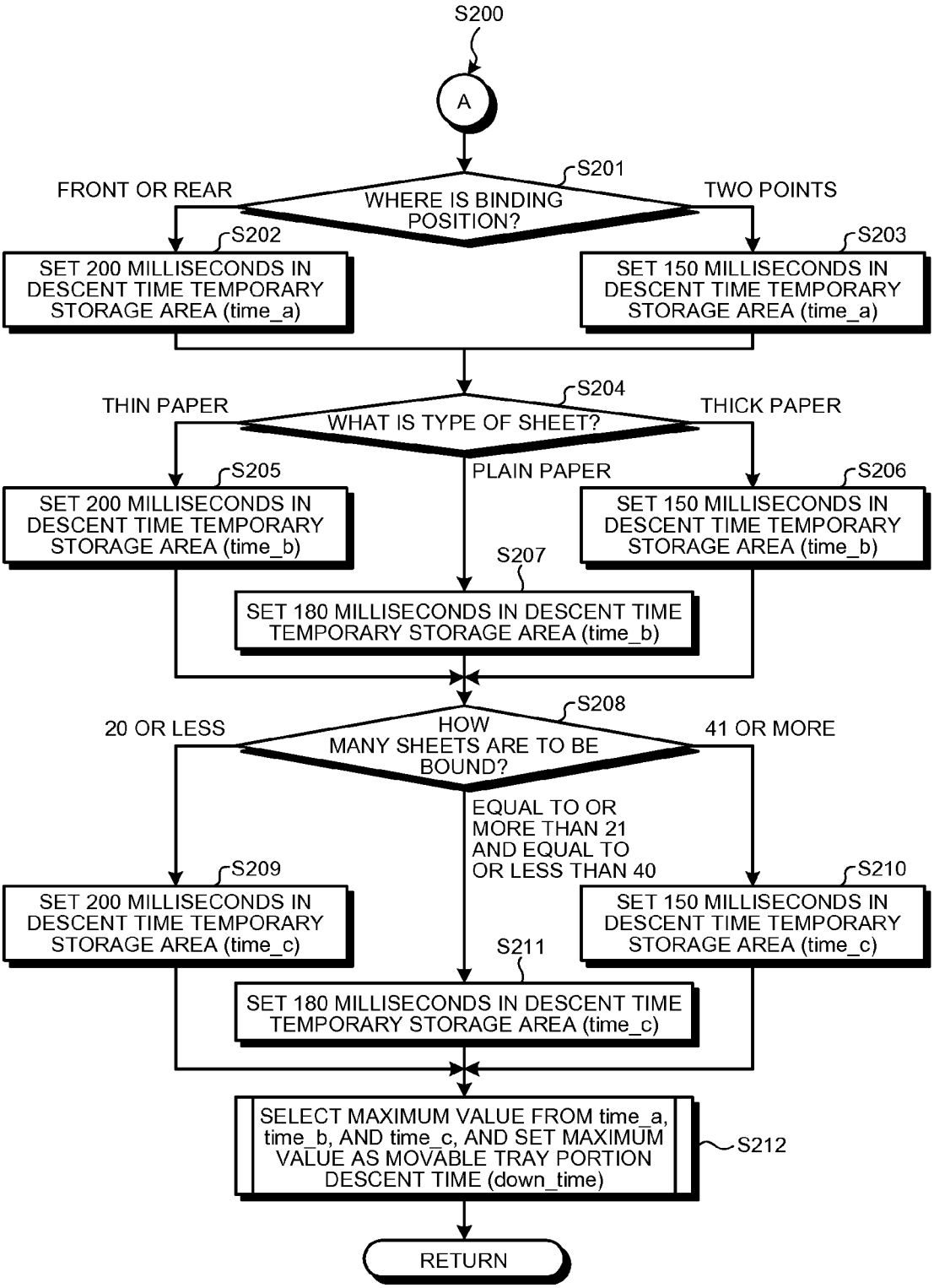

FIGS. 12A and 12B illustrate operations in the stapling mode when adjusting the downtime depending on all the conditions. In the operations illustrated in FIGS. 12A and 12B, a different section from that in the explanation with reference to FIG. 10 will now be explained. The different section is a subroutine section for determining the downtime performed by the control unit 96 functioning as the upward and downward driving control unit between Step S102 to Step S103 as Step S200.

Step S200 includes Step S201 to Step S203 for temporarily setting the downtime depending on the binding position of the transfer sheets S by the stapler 49, Step S204 to Step S207 for temporarily setting the downtime depending on the type of the transfer sheets S to be bound by the stapler 49, Step S208 to Step S211 for temporarily setting the downtime depending on the number of transfer sheets S to be bound by the stapler 49, and Step S211 for selecting the maximum value, that is, the longest time of the downtime thus temporarily set, and adopting and determining the longest time as the downtime used at Step S105.

Descent time temporary storage areas illustrated at Step S202, Step S203, Step S205, Step S206, Step S207, Step S209, Step S210, and Step S211 are areas that are configured by a memory provided to the control unit 96 functioning as the upward and downward driving control unit and that store therein the downtime thus temporarily set.

Therefore, the descent time temporary storage areas include time_a serving as an area that stores therein the downtime temporarily set depending on the binding position of the transfer sheets S by the stapler 49 from Step S201 to Step S203, time_b serving as an area that stores therein the downtime temporarily set depending on the type of the transfer sheets S to be bound by the stapler 49 from Step S204 to Step S207, and time_c serving as an area that stores therein the downtime temporarily set depending on the number of transfer sheets S to be bound by the stapler 49 from Step S208 to Step S211.

In temporary setting of the downtime performed from Step S201 to Step S203, a table illustrated in FIG. 13A is used. In temporary setting of the downtime performed from Step S204 to Step S207, a table illustrated in FIG. 13B is used. In temporary setting of the downtime performed from Step S208 to Step S211, a table illustrated in FIG. 13C is used.

A process for determining the downtime will now be described with reference to FIG. 12B. It is determined whether the binding position of the transfer sheets S by the stapler 49 is a position in front binding, rear binding, or two-point binding at Step S201. If the binding position is one of the positions in the front binding and the rear binding, 200 milliseconds are temporarily set as the downtime in accordance with the table illustrated in FIG. 13A, and are stored in the area time_a at Step S202. By contrast, if the binding position is the position in the two-point binding, 150 milliseconds are temporarily set as the downtime in accordance with the table illustrated in FIG. 13A, and are stored in the area time_a at Step S203.

Subsequently, it is determined whether the type of the transfer sheets S to be bound by the stapler 49 is thin paper, plain paper, or thick paper at Step S204. If the type is thin paper, 200 milliseconds are temporarily set as the downtime in accordance with the table illustrated in FIG. 13B, and are stored in the area time_b at Step S205. If the type is thick paper, 150 milliseconds are temporarily set as the downtime in accordance with the table illustrated in FIG. 13B, and are stored in the area time_b at Step S206. If the type is plain paper, 180 milliseconds are temporarily set as the downtime in accordance with the table illustrated in FIG. 13B, and are stored in the area time_b at Step S207.

Subsequently, it is determined whether the number of transfer sheets S to be bound by the stapler 49 is 20 or less, equal to or more than 21 and equal to or less than 40, or 41 or more at Step S208. If the number is 20 or less, 200 milliseconds are temporarily set as the downtime in accordance with the table illustrated in FIG. 13C, and are stored in the area time_c at Step S209. If the number is 41 or more, 150 milliseconds are temporarily set as the downtime in accordance with the table illustrated in FIG. 13C, and are stored in the area time_c at Step S210. If the number is equal to or more than 21 and equal to or less than 40, 180 milliseconds are temporarily set as the downtime in accordance with the table illustrated in FIG. 13C, and are stored in the area time_c at Step S211.

Subsequently, at Step S212, the downtime stored in the area time_a, the area time_b, and the area time_c as the temporary setting values is compared to select the maximum value. The maximum value is then set as the downtime, that is, as the movable tray portion descent time.

After the setting, processing at Step S103 and Step S104 is performed. Subsequently, at Step S105, the control unit 96 functioning as the upward and downward driving control unit waits until the downtime thus set elapses. If the downtime elapses, the control unit 96 functions as the upward and downward driving control unit, and stops driving of the tray DC motor 89*a*, thereby stopping the descent of the tip of the movable tray portion 17*b* (Step S106 in FIG. 12A).

The tables illustrated in FIGS. 13A, 13B, and 13C are stored in the control unit 96 functioning as the upward and downward driving control unit.

In the operations illustrated in FIGS. 12A and 12B, the operations explained with reference to FIG. 11 may be performed.

To temporarily set the downtime, the order of using the conditions of the position, the height, and the time is not limited to the order described above. Furthermore, any one of the conditions of the position, the height, and the time may be used. In this case, no temporary setting is required, and the downtime determined based on the condition thus used is simply employed at Step S105. Therefore, in this case, no area for storing therein downtime that is temporarily set or no processing for selecting the maximum value of the downtime thus temporarily set like Step S212 is required.

While the embodiments have been described, the embodiments are not intended to limit the invention. Unless otherwise noted in the explanation above, various changes and modifications can be made without departing from the spirit and scope of the invention.

For example, as long as the post-processing apparatus can perform post-processing by binding recording media on which an image is formed in the image forming apparatus, the post-processing apparatus is not necessarily an apparatus that is attachable to and detachable from the image forming apparatus, such as an apparatus provided as an option. Alternatively, the post-processing apparatus may be arranged integrally as an inner finisher in the image forming apparatus 100, that is, in the main body 99 in the present embodiment, or may be used as an apparatus independent of the image forming apparatus as a so-called stand-alone type post-processing apparatus.

Furthermore, the image forming apparatus is not necessarily an MFP of a copying machine, a printer, and a facsimile. Alternatively, the image forming apparatus may be a single item of each element, be a printing device, or be an MFP of another combination, such as a copying machine and a printer.

According to one of the embodiments, it is possible to provide a post-processing apparatus including a stacking tray on which recording media are stacked; an upward and downward driving unit that drives the stacking tray in upward and downward directions; a binding unit that performs binding on recording media part of whose leading edge in a conveying direction of the recording media toward the stacking tray is positioned on the stacking tray; and an upward and downward driving control unit that controls the upward and downward driving unit such that, when the binding unit performs the binding, descent of the stacking tray is performed before the leading edge of a first sheet among the recording media on which the binding is to be performed reaches a position on the stacking tray, and after the leading edge of the first sheet is positioned on the stacking tray, ascent of the stacking tray is performed before the leading edge of a second sheet among the recording media on which the binding is to be performed reaches a position on the stacking tray, or to provide an image forming apparatus including the post-processing apparatus. Therefore, the reliability in discharging the first sheet among the recording media and the bound recording media onto the stacking tray can be improved. In addition, the state of the recording media on the stacking tray is made excellent, whereby the binding on the recording media can be performed properly. Accordingly, it is possible to provide a post-processing apparatus capable of improving the usability and the reliability for the user, or an image forming apparatus including the post-processing apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A post-processing apparatus comprising:

a stacking tray on which recording media are stacked;

an upward and downward driving unit that drives the stacking tray in upward and downward directions;

a binding unit that performs binding on recording media part of whose leading edge in a conveying direction of the recording media toward the stacking tray is positioned on the stacking tray; and an upward and downward driving control unit that controls the upward and downward driving unit such that, when the binding unit performs the binding, descent of the stacking tray is performed before a leading edge of a first sheet among the recording media on which the binding is to be performed reaches a position on the stacking tray, and after the leading edge of the first sheet is positioned on the stacking tray, ascent of the stacking tray is performed before a leading edge of a second sheet among the recording media on which the binding is to be performed reaches a position on the stacking tray.

2. The post-processing apparatus according to claim 1, further comprising:

a position detection unit that detects a position of an uppermost recording medium whose whole body is stacked on the stacking tray, wherein the upward and downward driving control unit controls the upward and downward driving unit such that the position of the uppermost recording medium is at a predetermined position.

3. The post-processing apparatus according to claim 2, wherein, when the binding unit performs the binding, the upward and downward driving control unit performs the descent from the predetermined position in a manner corresponding to a height obtained by adding an upward deformation amount of the uppermost recording medium.

4. The post-processing apparatus according to claim 2, wherein, when the binding unit performs the binding, the upward and downward driving control unit performs the descent from the predetermined position by a height depending on at least one of a binding position of the recording media by the binding unit, a type of the recording media on which the binding is to be performed, and number of the recording media on which the binding is to be performed.

5. The post-processing apparatus according to claim 1, wherein the post-processing apparatus is attachable to and detachable from an image forming apparatus, and is capable of performing the binding by the binding unit on recording media on which an image is formed in the image forming apparatus.

6. An image forming apparatus comprising:

the post-processing apparatus according to claim 1, wherein the image forming apparatus is capable of performing the binding by the binding unit on recording media on which an image is formed.

7. The image forming apparatus according to claim 6, wherein the post-processing apparatus is provided inside thereof as an inner finisher.

8. The post-processing apparatus according to claim 1, wherein the stacking tray includes a non-movable portion and a movable portion hingedly fixed to the non-movable portion, and the upward and downward driving unit is attached to the movable portion of the stacking tray such that the movable portion moves relative to the non-movable portion.

* * * * *